US009695644B2

(12) United States Patent
DeBerry et al.

(10) Patent No.: US 9,695,644 B2
(45) Date of Patent: Jul. 4, 2017

(54) SMART RISER HANDLING TOOL

(71) Applicant: Dril-Quip, Inc., Houston, TX (US)

(72) Inventors: Blake T. DeBerry, Houston, TX (US); Morris B. Wade, Houston, TX (US)

(73) Assignee: Drill-Quip Inc., Houston, TX (US)

( * ) Notice: Subject to any disclaimer, the term of this patent is extended or adjusted under 35 U.S.C. 154(b) by 0 days.

(21) Appl. No.: 14/961,654

(22) Filed: Dec. 7, 2015

(65) Prior Publication Data

US 2016/0084065 A1 Mar. 24, 2016

Related U.S. Application Data

(63) Continuation-in-part of application No. 14/618,411, filed on Feb. 10, 2015, now Pat. No. 9,206,654, which is a continuation-in-part of application No. 13/892,823, filed on May 13, 2013, now Pat. No. 8,978,770, application No. 14/961,654, which is a continuation-in-part of application No. 14/618,453, filed on Feb. 10, 2015, now Pat. No. 9,222,318, which is a continuation-in-part of application No. 13/892,823, filed on May 13, 2013, now Pat. No. 8,978,770, application No. 14/961,654, which is a continuation-in-part of application No. 14/618,497, filed on Feb. 10, 2015, now Pat. No. 9,228,397, which (Continued)

(51) Int. Cl.

| | |
|---|---|
| ***E21B 17/01*** | (2006.01) |
| ***E21B 19/16*** | (2006.01) |
| ***E21B 17/08*** | (2006.01) |

(52) U.S. Cl.
CPC ..... *E21B 17/01* (2013.01); *E21B 17/085* (2013.01); *E21B 19/165* (2013.01)

(58) Field of Classification Search
CPC .... E21B 47/0001; E21B 17/01; E21B 17/046; E21B 17/085; E21B 19/002; E21B 19/004; E21B 19/06; E21B 19/10; E21B 19/16; E21B 19/165
See application file for complete search history.

(56) References Cited

U.S. PATENT DOCUMENTS 2,507,261 A 5/1950 Mercier
3,498,648 A 3/1970 Hallesy
(Continued)

FOREIGN PATENT DOCUMENTS

WO WO 2014078094 A2 * 5/2014 ..... E21B 33/035

*Primary Examiner* — Matthew R Buck
(74) *Attorney, Agent, or Firm* — Baker Botts L.L.P.

(57) ABSTRACT

Systems and methods for a smart riser handling tool are disclosed. The riser handling tool may be movable to manipulate an equipment asset, such as a riser component. The riser handling tool may include one or more sensors for measuring one or more properties associated with the equipment asset, and a communication system coupled to the one or more sensors to communicate data indicative of the one or more measured properties to an operator monitoring system. In some embodiments, the riser handling tool may include an electronic identification reader for identifying the equipment asset, and the communication system may be coupled to the electronic identification reader to communicate data indicative of the equipment asset identification to the operator monitoring system.

20 Claims, 34 Drawing Sheets

Related U.S. Application Data is a continuation-in-part of application No. 13/892,823.

(60) Provisional application No. 61/646,847, filed on May 14, 2012.

(56) References Cited

U.S. PATENT DOCUMENTS 4,491,346 A * 1/1985 Walker ..... E21B 33/038 285/18
4,496,172 A * 1/1985 Walker ..... E21B 33/038 285/18
4,557,508 A * 12/1985 Walker ..... E21B 33/038 285/315
5,421,623 A * 6/1995 Cassin ..... F16L 21/00 285/343
5,441,311 A * 8/1995 Watkins ..... F16L 37/002 285/18
5,634,671 A * 6/1997 Watkins ..... E21B 17/085 166/344
5,899,507 A 5/1999 Schroeder et al.
6,824,171 B2 11/2004 Milberger et al.
7,331,395 B2 * 2/2008 Fraser ..... E21B 17/01 166/344
7,337,848 B2 * 3/2008 Fraser ..... E21B 17/01 166/344
7,503,391 B2 * 3/2009 McCanna ..... E21B 33/038 166/343
7,686,087 B2 * 3/2010 Pallini ..... E21B 17/085 166/338
7,686,342 B2 * 3/2010 Jennings ..... E21B 17/085 285/323
7,913,767 B2 * 3/2011 Larson ..... E21B 17/085 166/242.6
7,963,336 B2 * 6/2011 Fraser ..... E21B 17/01 166/344
7,975,768 B2 * 7/2011 Fraser ..... E21B 17/01 166/344
8,312,933 B2 * 11/2012 Larson ..... E21B 17/085 166/344
8,317,234 B2 * 11/2012 McKay ..... E21B 33/038 285/18
8,356,672 B2 * 1/2013 Fraser ..... E21B 17/01 166/344
8,978,770 B2 * 3/2015 DeBerry ..... E21B 17/085 166/344
9,091,604 B2 * 7/2015 Kobata ..... E21B 44/00
9,109,404 B2 * 8/2015 Gilmore ..... E21B 17/01
2002/0158120 A1 * 10/2002 Zierolf ..... E21B 17/006 235/375
2009/0188675 A1 * 7/2009 Bloom ..... E21B 15/00 166/381
2009/0205820 A1 * 8/2009 Koederitz ..... E21B 10/00 166/250.01
2009/0208295 A1 * 8/2009 Kinert ..... E21B 17/006 405/224.2
2011/0204143 A1 * 8/2011 Mackenzie ..... E21B 17/006 235/385
2012/0172072 A1 * 7/2012 Baxter ..... E21B 17/01 455/500
2013/0076028 A1 3/2013 Pallini et al.
2014/0060851 A1 * 3/2014 Mackenzie ..... E21B 17/006 166/367
2016/0340988 A1 * 11/2016 Abou-Assaad ..... E21B 19/165

* cited by examiner

SMART RISER HANDLING TOOL

CROSS-REFERENCE TO RELATED APPLICATIONS

The present application is a continuation in part of U.S. patent application Ser. No. 14/618,411, entitled "Systems and Methods for Riser Coupling", filed on Feb. 10, 2015; U.S. patent application Ser. No. 14/618,453, entitled "Systems and Methods for Riser Coupling", filed on Feb. 10, 2015; and U.S. patent application Ser. No. 14/618,497, entitled "Systems and Methods for Riser Coupling", filed on Feb. 10, 2015. All three of these pending applications are continuations in part of U.S. patent application Ser. No. 13/892,823, entitled "Systems and Methods for Riser Coupling", filed on May 13, 2013, which claims the benefit of provisional application Ser. No. 61/646,847, entitled "Systems and Methods for Riser Coupling", filed on May 14, 2012. All of these applications are herein incorporated by reference.

BACKGROUND

The present disclosure relates generally to well risers and, more particularly, to a smart handling tool for constructing and deconstructing a riser.

In drilling or production of an offshore well, a riser may extend between a vessel or platform and the wellhead. The riser may be as long as several thousand feet, and may be made up of successive riser sections. Riser sections with adjacent ends may be connected on board the vessel or platform, as the riser is lowered into position. Auxiliary lines, such as choke, kill, and/or boost lines, may extend along the side of the riser to connect with the BOP, so that fluids may be circulated downwardly into the wellhead for various purposes. Connecting riser sections in end-to-end relation includes aligning axially and angularly two riser sections, including auxiliary lines, lowering a tubular member of an upper riser section onto a tubular member of a lower riser section, and locking the two tubular members to one another to hold them in end-to-end relation.

The riser section connecting process may require significant operator involvement that may expose the operator to risks of injury and fatigue. For example, the repetitive nature of the process over time may create a risk of repetitive motion injuries and increasing potential for human error. Moreover, the riser section connecting process may involve heavy components and may be time-intensive. Therefore, there is a need in the art to improve the riser section connecting process and address these issues.

BRIEF DESCRIPTION OF THE DRAWINGS

Some specific exemplary embodiments of the disclosure may be understood by referring, in part, to the following description and the accompanying drawings.

Figure 1A:
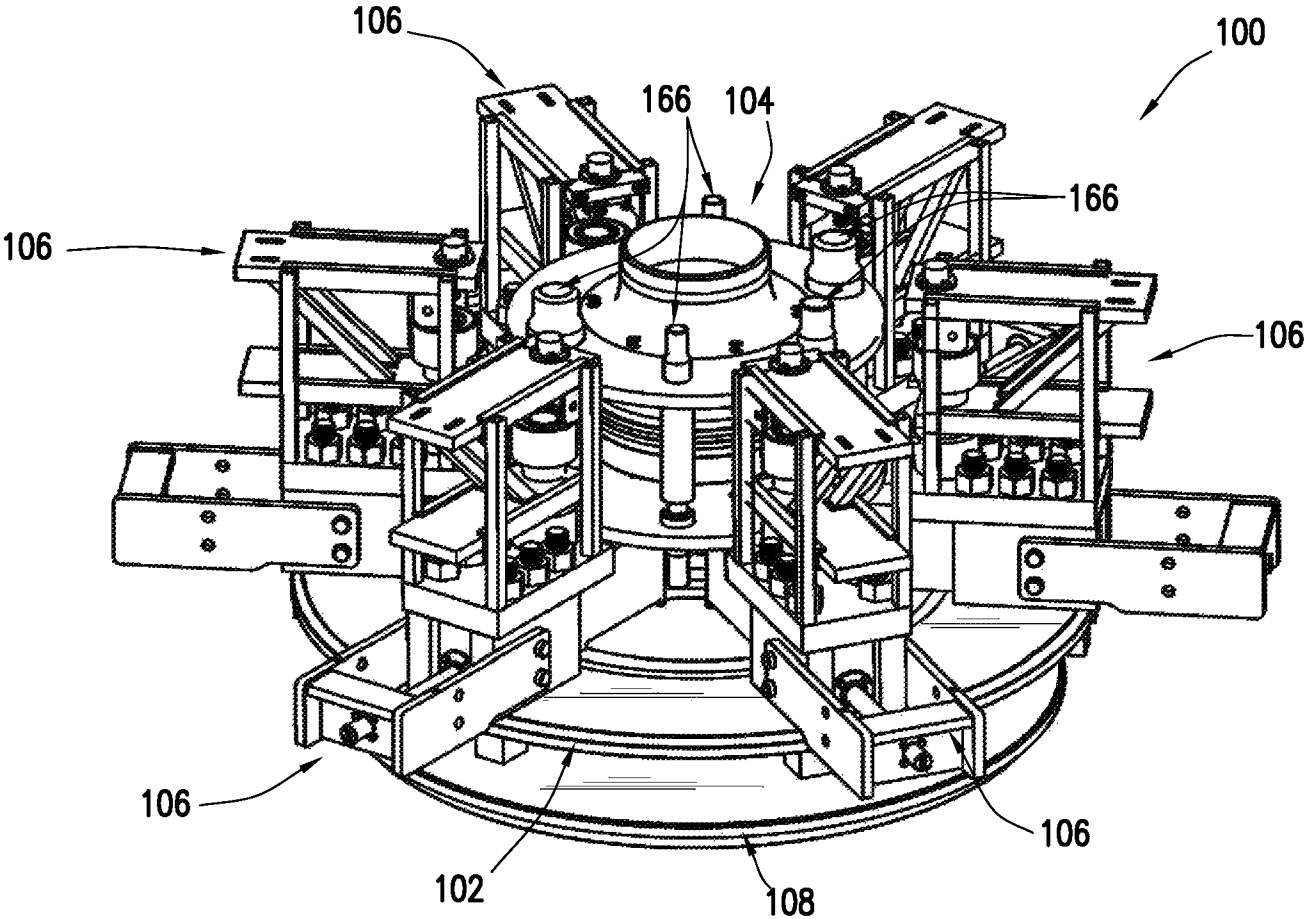
FIG. 1A shows an angular view of one exemplary riser coupling system, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well risers and, more particularly, to systems and methods for a smart riser handling tool.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves; and/or any combination of the foregoing.

For the purposes of this disclosure, a sensor may include any suitable type of sensor, including but not limited to optical, radio frequency, acoustical, pressure, torque, or proximity sensors.

Figure 1B:
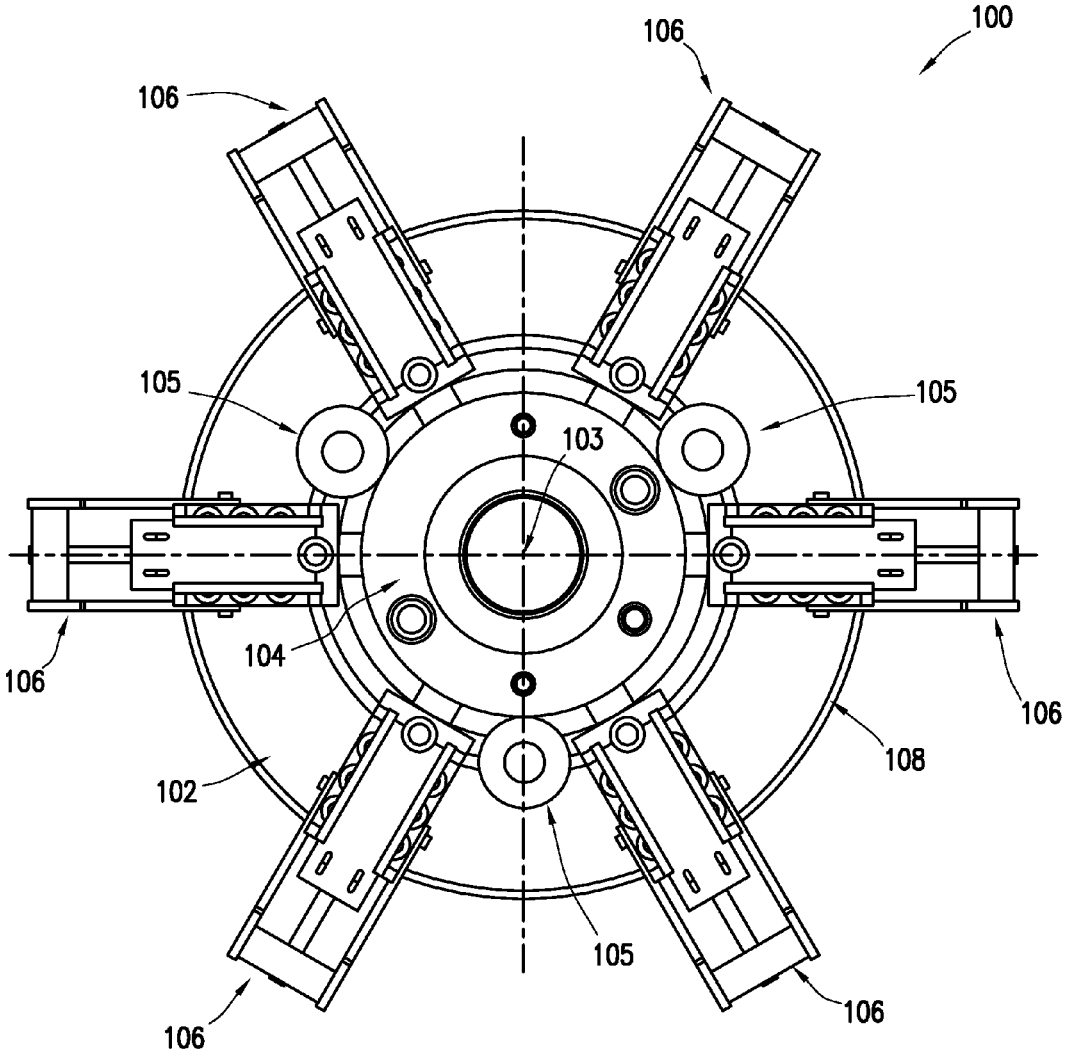
FIG. 1B shows a top view of a riser coupling system, in accordance with certain embodiments of the present disclosure.

FIG. 1A shows an angular view of one exemplary riser coupling system 100, in accordance with certain embodiments of the present disclosure. FIG. 1B shows a top view of the riser coupling system 100. The riser coupling system 100 may include a spider assembly 102 adapted to one or more of receive, at least partially orient, engage, hold, and actuate a riser joint connector 104. The spider assembly 102 may include one or more connector actuation tools 106. In certain embodiments, a plurality of connector actuation tools 106 may be spaced radially about an axis 103 of the spider assembly 102. By way of nonlimiting example, two connector actuation tools 106 may be disposed around a circumference of the spider assembly 102 in an opposing placement. The nonlimiting example of FIG. 1 show three pairs of opposing connector actuation tools 106. It should be understood that various embodiments may include any suitable number of connector actuation tools 106.

As depicted in FIG. 1B, certain embodiments may include one or more orienting members 105 disposed radially about the axis 103 to facilitate orientation of the riser joint connector 104. By way of example without limitation, three orienting members 105 may include a cylindrical or generally cylindrical form extending upwards from a surface of the spider assembly 102. The orienting members 105 may act as guides to interface the riser joint connector 104 as the riser joint connector 104 is lowered toward the spider assembly 102, thereby facilitating orientation and/or alignment. In certain embodiments, the orienting members 105 may be fitted with one or more sensors (not shown) to detect position and/or orientation of the riser joint connector 104, and corresponding signals may be transferred to an information handling system at any suitable location on a vessel or platform by any suitable means, including wired or wireless means.

The spider assembly 102 may include a base 108. The base 108, and the spider assembly 102 generally, may be mounted directly or indirectly on a surface of a vessel or platform. For example, the base 108 may be disposed on or proximate to a rig floor. In certain embodiments, the base 108 may include or be coupled to a gimbal mount to facilitate balancing in spite of sea sway.

Figure 12:
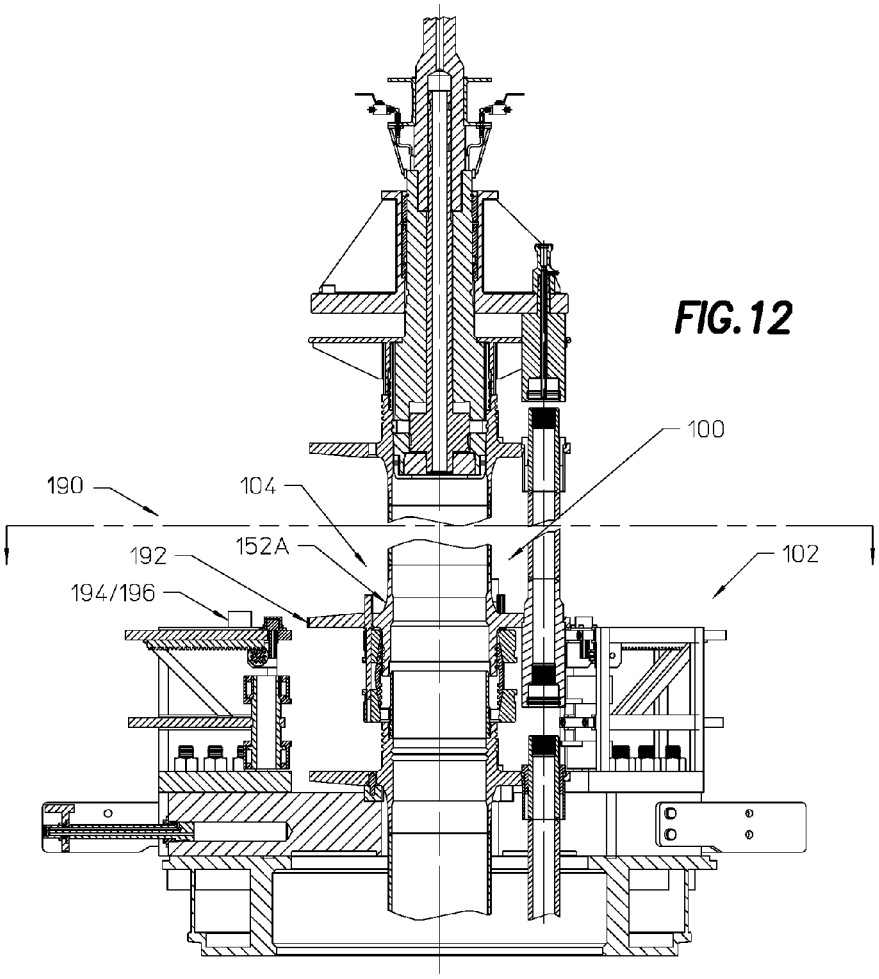
FIG. 12 shows a schematic view of an orientation system for aligning a riser joint within a riser coupling system, in accordance with certain embodiments of the present disclosure.

As mentioned above, certain embodiments of the spider assembly 102 and the riser connector assembly 104 may be fitted with sensors to enable determination of an orientation of the riser connector assembly 104 being positioned within the spider 102 (e.g., via a running tool). As illustrated in FIG. 12, for example, the riser coupling system 100 may include a radio frequency identification (RFID) based orientation system 190 for aligning a riser joint connector 104 within the riser coupling system 100. This RFID orientation system 190 may include one or more RFID tags 192 disposed on the riser joint connector 104 and an RFID reader 194 disposed on a section of the spider assembly 102, with one or more RFID antennae.

Each RFID tag 192 may be an electronic device that absorbs electrical energy from a radio frequency (RF) field. The RFID tag 192 may then use this absorbed energy to broadcast an RF signal containing a unique serial number to the RFID reader 194. In some embodiments, the RFID tags 192 may include on-board power sources (e.g., batteries) for powering the RFID tags 192 to output their unique RF signals to the reader 194. The signal output from the RFID tags 192 may be within the 900 MHz frequency band.

The RFID reader 194 may be a device specifically designed to emit RF signals and having an antenna to capture information (i.e., RF signals with serial numbers) from the RFID tags 192. The RFID reader 194 may respond differently depending on the relative position of the reader 194 to the one or more tags 192. For example, the RFID reader 194 may slowly capture the RF signal from the RFID tag 192 when the RFID tag 192 and the antenna of the RFID reader 194 are far apart. This may be the case when the riser joint connector 104 is out of alignment with the spider assembly 102. The RFID reader 194 may quickly capture the signal from the RFID tag 192 when the optimum alignment between the antenna of the reader 194 and the RFID tag 192 is achieved. In the illustrated embodiment, the riser joint connector 104 is oriented about the axis 103 such that one of the RFID tags 192 is as close as possible to the RFID reader 194, indicating that the riser joint connector 104 is in a desired rotational alignment within the riser coupling system 100.

The change in speed of response of the RFID reader 194 may be related to the field strength of the signal from the RFID tag 192 and may be directly related to the distance between the RFID tag 192 (transmitter) and the RFID reader 194 (receiver). The RFID reader 194 may take a signal strength measurement, also known as "receiver signal strength indicator" (RSSI), and provide this measurement to a controller 196 (e.g., information handling system) to determine whether the riser joint connector 104 is aligned with the spider assembly 102. The RSSI may be an electrical signal or computed value of the strength of the RF signal received via the RFID reader 194. An internally generated signal of the RFID reader 194 may be used to tune the receiver for optimal signal reception. The controller 196 may be communicatively coupled to the RFID reader 194 via a wired or wireless connection, and the controller 196 may also be communicatively coupled to actuators, running tools, or various operable components of the spider assembly 102.

In some embodiments, the RFID reader 194 may emit a constant power level RF signal, in order to activate any RFID tags 192 that are within range of the RF signal (or RF field). It may be desirable for the RFID reader 192 to emit a constant power signal, since the RF signal strength output from the RFID tags 192 is proportional to both distance and frequency of the signal. In the application described herein, the distance from the antenna of the RFID reader 194 to the RFID tag 192 may be used to locate the angular position of the riser joint connector 104 relative to the RFID reader 194.

Figure 13:
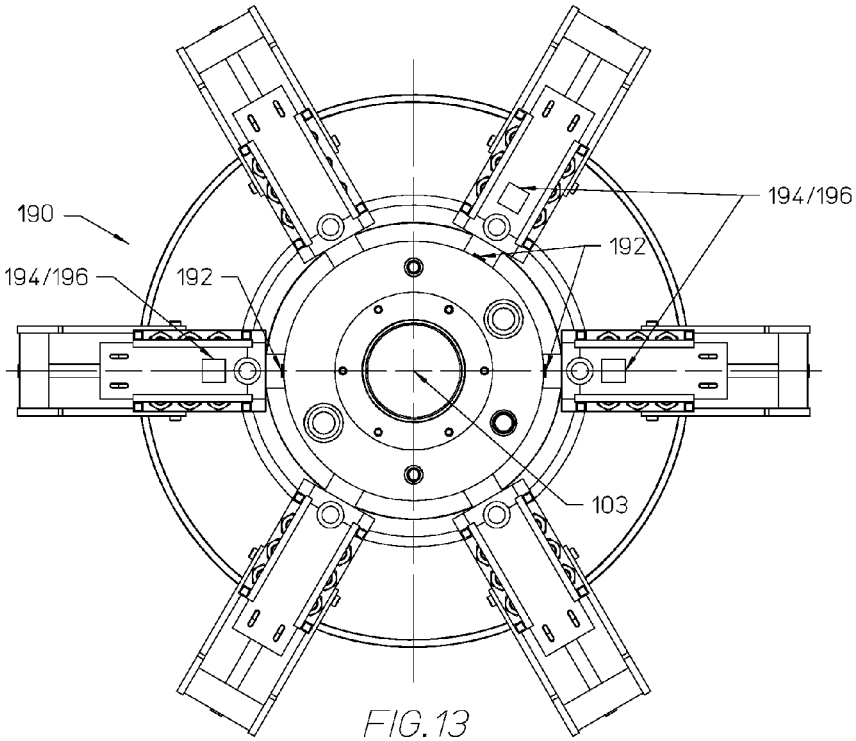
FIG. 13 shows a schematic view of a section of a riser joint with multiple RFID tags positioned thereon, in accordance with certain embodiments of the present disclosure.

In certain embodiments, the one or more RFID tags 192 may be disposed on a flange of a riser tubular that forms part of the riser joint connector 104. For example, the RFID tags 192 may be embedded onto a lower riser flange 152A of a tubular assembly 152 being connected with other tubular assemblies via the riser coupling system 100. From this position, the RFID tags 192 may react to the RF field from the RFID reader 194. It may be desirable to embed the RFID tags 192 into only one of two available riser flanges 152A along the tubular assembly 152, since RFID tags disposed on two adjacent riser flanges being connected could cause undesirable interference in the signal readings taken by the reader 194. As illustrated in FIG. 13, the flange 152A of the riser joint connector 104 may include three RFID tags 192 disposed thereabout. It should be noted that other numbers (e.g., 1, 2, 4, 5, or 6) of the RFID tags 192 may be disposed about the flange 152A in other embodiments. In some embodiments, the multiple RFID tags 192 may be generally disposed at equal rotational intervals around the flange 152A. In other embodiments, such as the illustrated embodiment of FIG. 13, the RFID tags 192 may be positioned in other arrangements. In still other embodiments, the RFID tags 192 may be disposed along other parts of the riser joint connector 104.

In some embodiments, a single RFID reader 194 may be used to detect RF signals indicative of proximity of the RFID tags 192 to the reader 194. The use of one RFID reader 194 may help to maintain a constant power signal emitted in the vicinity of the RFID tags 192 for initiating RF readings. In other embodiments, however, the RFID based orientation system 190 may utilize more than one reader 194. In the illustrated embodiment, the RFID reader 194 may be disposed on the spider assembly 102, near where the spider assembly 102 meets the riser joint connector 104. It should be noted that, in other embodiments, the RFID reader 194 may be positioned or embedded along other portions of the riser coupling system 100 that are rotationally stationary with respect to the spider assembly 102.

As the riser joint connector 104 is lowered to the spider assembly 102 for makeup, the RFID tags 192 embedded into the edge of the riser flange may begin to respond to the RF field output via the reader 194. Based on the Received Signal Strength Indication (RSSI) received at the RFID reader 194 in response to the RFID tags 192, the controller 196 may output a signal to a running tool and/or an orienting device to rotate the riser joint connector 104 about the axis 103. The tools may rotate the riser joint connector 104 until the riser joint connector 104 is brought into a desirable alignment with the spider assembly 102 based on the signal received at the reader 194. Upon aligning the riser joint connector 104, the running tool may then lower the riser joint connector 104 into the spider assembly 102, and the spider assembly 102 may actuate the riser joint connector 104 to lock the tubular assembly 152 to a lower tubular assembly (not shown).

Once the riser joint connector 104 is locked and lowered into the sea, the RFID tags 192 may shut off in response to the tags 192 being out of range of the RFID transmitter/reader 194. In embodiments where the electrical power is transferred to the RFID tags 192 via RF signals from the reader 194, there are no batteries to change out or any concerns over electrical connections to the RFID tags 192 that are then submersed in water. The RFID orientation system 190 may provide accurate detection of the rotational positions of the riser joint connector 104 with respect to the spider assembly 102 before setting the riser joint connector 104 in place and making the riser connection. By sensing the signal strength of embedded RFID tags 192, the RFID orientation system 190 is able to provide this detection without the use of complicated mechanical means (e.g., gears, pulleys) or electronic encoders for detecting angular rotation and alignment. Once the alignment of the riser joint connector 104 is achieved, the RFID reader 190 may shutoff the RF power transmitter 194, thereby silencing the RFID tags 192.

Figure 2:
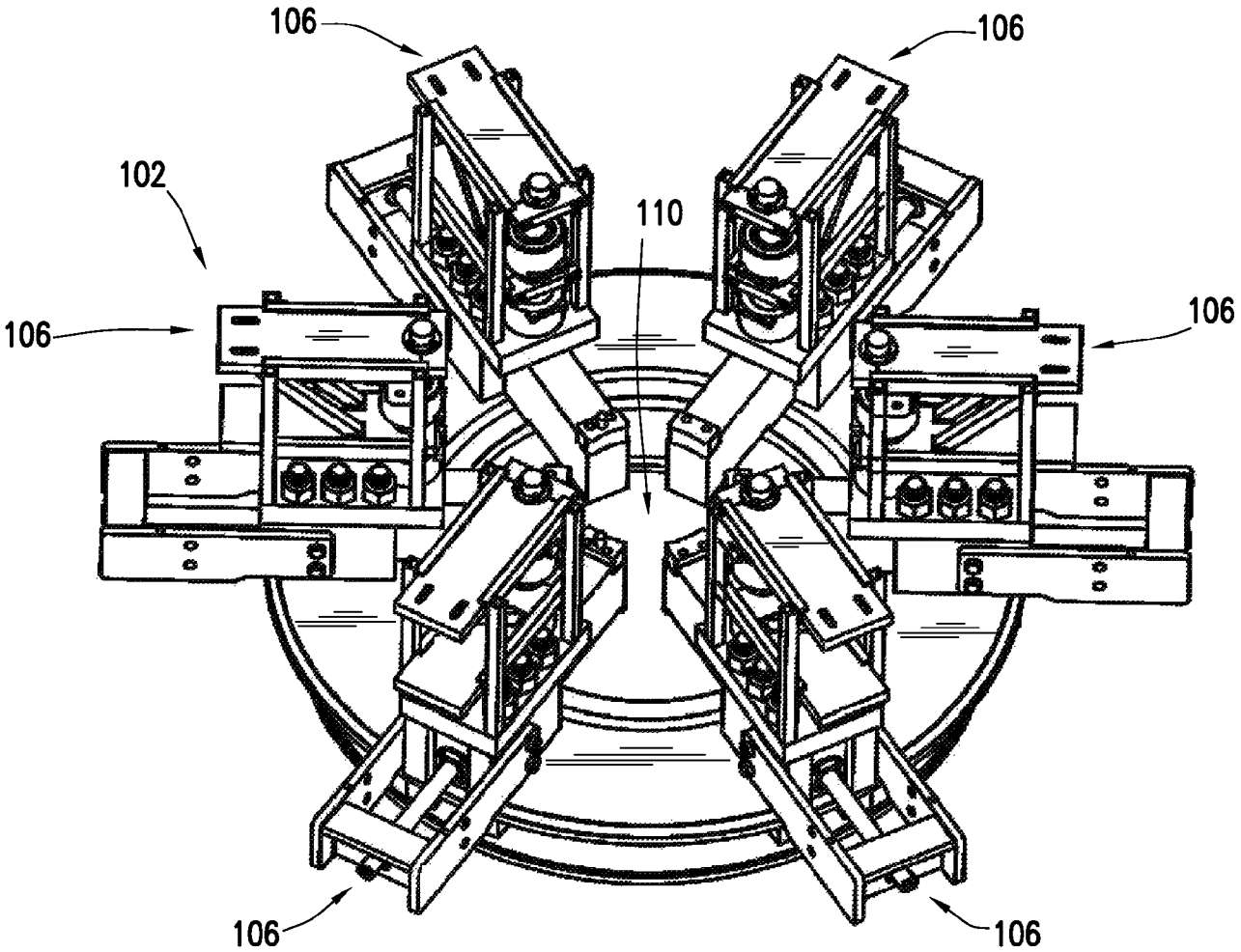
FIG. 2 shows a top elevational view of a spider assembly prior to receiving a connector assembly, in accordance with certain embodiments of the present disclosure.

FIG. 2 shows an angular view of the spider assembly 102 prior to receiving the riser joint connector 104 (depicted in FIGS. 1A and 1B). The nonlimiting example of the spider assembly 102 with the base 108 includes a generally circular geometry about a central opening 110 configured for running riser sections therethrough. Various alternative embodiments may include any suitable geometry.

Figure 3A:
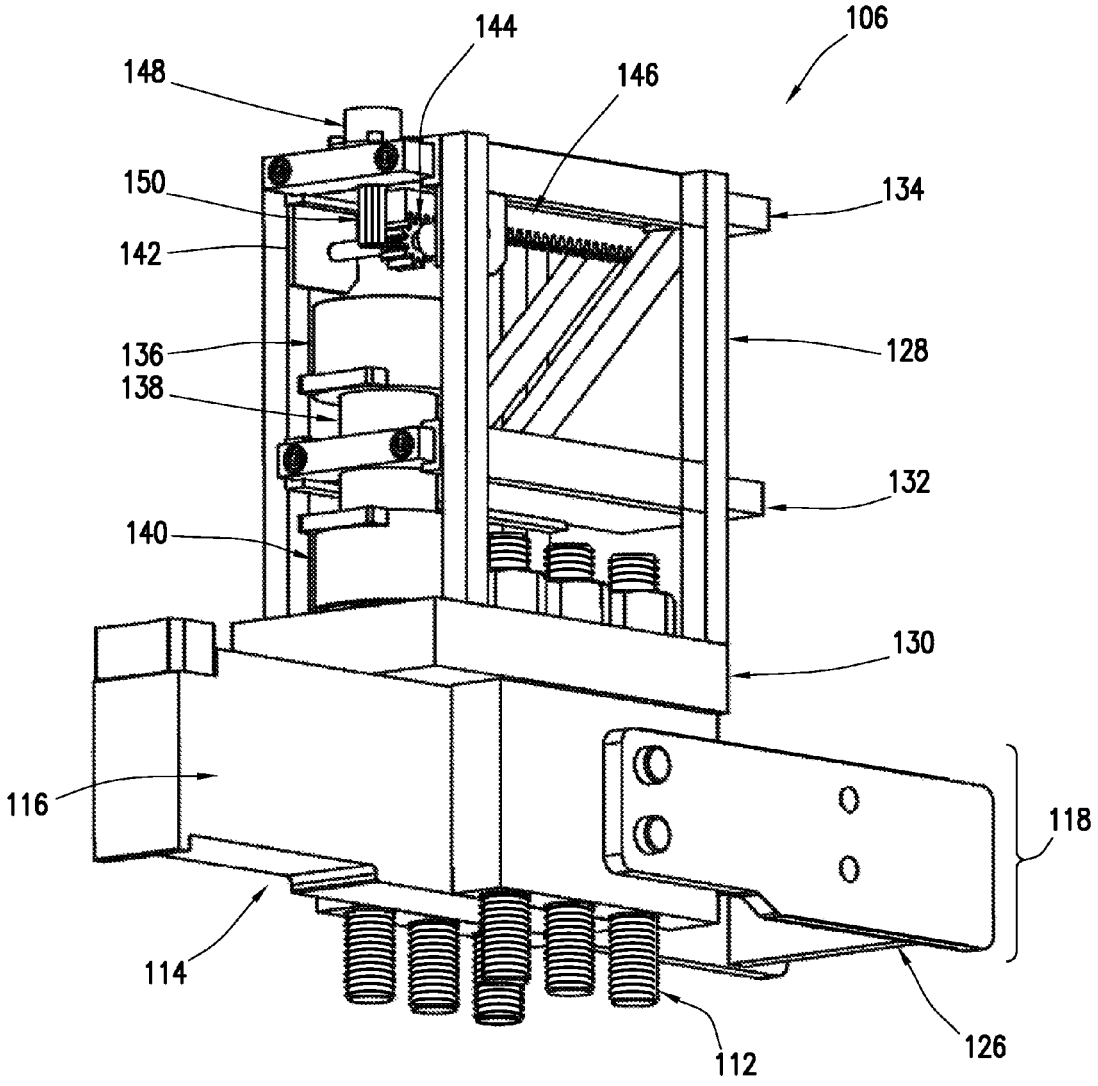
FIG. 3A shows a side elevational view of one exemplary connector actuation tool, in accordance with certain embodiments of the present disclosure.
Figure 3B:
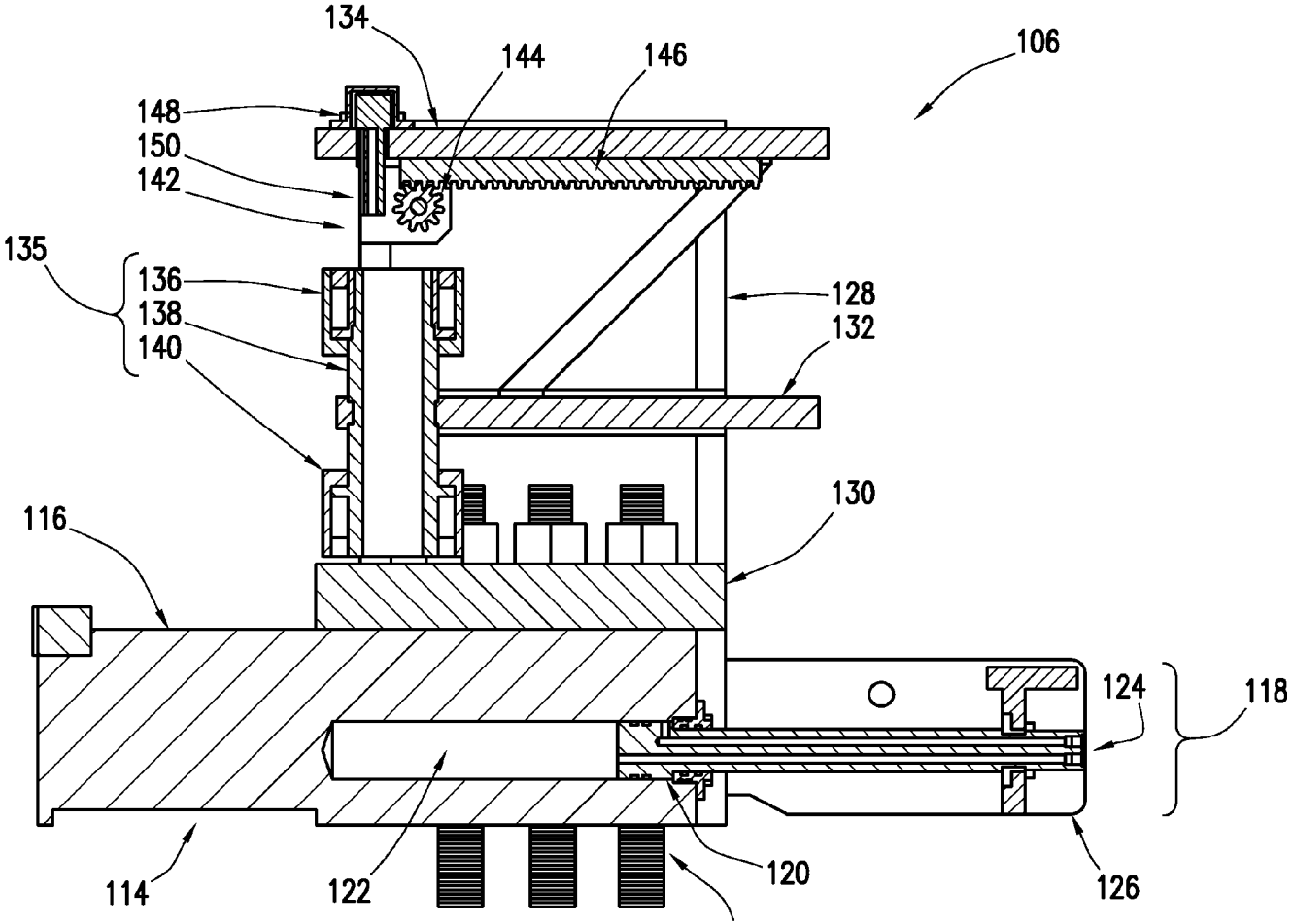
FIG. 3B shows a cross-sectional view of a connector actuation tool, in accordance with certain embodiments of the present disclosure.

FIG. 3A shows an angular view of one exemplary connector actuation tool 106, in accordance with certain embodiments of the present disclosure. FIG. 3B shows a cross-sectional view of the connector actuation tool 106. The connector actuation tool 106 may include a connection means 112 to allow connection to the base 108 (omitted in FIGS. 3A, 3B). As depicted, the connection means 112 may include a number of threaded bolts. However, it should be appreciated that any suitable means of coupling, directly or indirectly, the connector actuation tool 106 to the rest of the spider assembly 102 (omitted in FIGS. 3A, 3B) may be employed.

The connector actuation tool 106 may include a dog assembly 114. The dog assembly 114 may include a dog 116 and a piston assembly 118 configured to move the dog 116. The piston assembly 118 may include a piston 120, a piston cavity 122, one or more hydraulic lines 124 to be fluidly coupled to a hydraulic power supply (not shown), and a bracket 126. The bracket 126 may be coupled to a support frame 128 and the piston 120 so that the piston 120 remains stationary relative to the support frame 128. The support frame 128 may include or be coupled to one or more support plates. By way of example without limitation, the support frame 128 may include or be coupled to support plates 130, 132, and 134. The support plate 130 may provide support to the dog 116.

With suitable hydraulic pressure applied to the piston assembly 118 from the hydraulic power supply (not shown), the piston cavity 122 may be pressurized to move the dog 116 with respect to one or more of the piston 120, the bracket 126, the support frame 128, and the support plate 130. In the non-limiting example depicted, each of the piston 120, the bracket 126, the support frame 128, and the support plate 130 is adapted to remain stationary though the dog 116 moves. FIGS. 3A and 3B depict the dog 116 in an extended state relative to the rest of the connector actuation tool 106.

The connector actuation tool 106 may include a clamping tool 135. By way of example without limitation, the clamping tool 135 may include one or more of an upper actuation piston 136, an actuation piston mandrel 138, and a lower actuation piston 140. Each of the upper actuation piston 136 and the lower actuation piston 140 may be fluidically coupled to a hydraulic power supply (not shown) and may be moveably coupled to the actuation piston mandrel 138. With suitable hydraulic pressure applied to the upper and lower actuation pistons 136, 140, the upper and lower actuation pistons 136, 140 may move longitudinally along the actuation piston mandrel 138 toward a middle portion of the actuation piston mandrel 138. FIGS. 3A and 3B depict the upper and lower actuation pistons 136, 140 in a non-actuated state.

The actuation piston mandrel 138 may be extendable and retractable with respect to the support frame 128. A motor 142 may be drivingly coupled to the actuation piston mandrel 138 to selectively extend and retract the actuation piston mandrel 138. By way of example without limitation, the motor 142 may be drivingly coupled to a slide gear 144 and a slide gear rack 146, which may in turn be coupled to the support plate 134, the support plate 132, and the actuation piston mandrel 138. The support plates 132, 134 may be moveably coupled to the support frame 128 to extend or retract together with the actuation piston mandrel 138, while the support frame 128 remains stationary. FIGS. 3A and 3B depict the slide gear rack 146, the support plates 132, 134, and the actuation piston mandrel 138 in a retracted state relative to the rest of the connector actuation tool 106.

The connector actuation tool 106 may include a motor 148, which may be a torque motor, mounted with the support plate 134 and driving coupled to a splined member 150. The splined member 150 may also be mounted to extend and retract with the support plate 134. It should be understood that while one non-limiting example of the connector actuation tool 106 is depicted, alternative embodiments may include suitable variations, including but not limited to, a dog assembly at an upper portion of the connector actuation tool, any suitable number of actuation pistons at any suitable position of the connector actuation tool, any suitable motor arrangements, and the use of electric actuators instead of or in combination with hydraulic actuators.

In certain embodiments, the connector actuation tool 106 may be fitted with one or more sensors (not shown) to detect position, orientation, pressure, and/or other parameters of the connector actuation tool 106. For nonlimiting example, one or more sensors may detect the positions of the dog 116, the clamping tool 135, and/or splined member 150. Corresponding signals may be transferred to an information handling system at any suitable location on the vessel or platform by any suitable means, including wired or wireless means. In certain embodiments, control lines (not shown) for one or more of the motor 148, clamping tool 135, and dog assembly 114 may be feed back to the information handling system by any suitable means.

Figure 4:
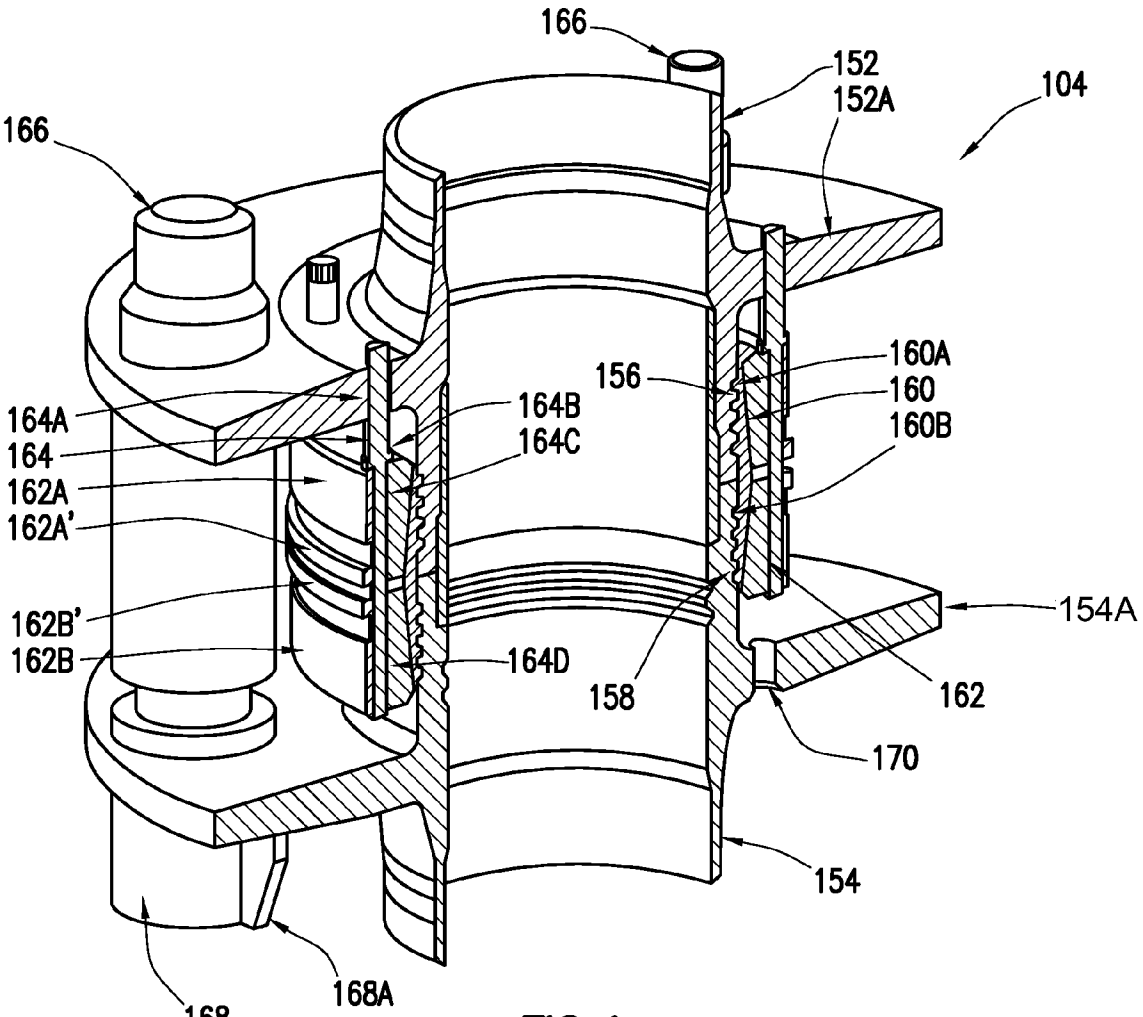
FIG. 4 shows a partially cut-away side elevational view of a connector assembly, in accordance with certain embodiments of the present disclosure.

FIG. 4 shows a cross-sectional view of a riser joint connector 104, in accordance with certain embodiments of the present disclosure. The riser joint connector 104 may include an upper tubular assembly 152 and a lower tubular assembly 154, each arranged in end-to-end relation. The upper tubular assembly 152 sometimes may be referenced as a box; the lower tubular assembly 154 may be referenced as a pin.

Certain embodiments may include a seal ring (not shown) between the tubular members 152, 154. The upper tubular assembly 152 may include grooves 156 about its lower end. The lower member 154 may include grooves 158 about its upper end. A lock ring 160 may be disposed about the grooves 156, 158 and may include teeth 160A, 160B. The teeth 160A, 160B may correspond to the grooves 156, 158. The lock ring 160 may be radially expandable and contractible between an unlocked position in which the teeth 160A, 160B are spaced from the grooves 156, 158, and a locking position in which the lock ring 160 has been forced inwardly so that teeth 160A, 160B engage with the grooves 156, 158 and thereby lock the connection. Thus, the lock ring 160 may be radially moveable between a normally expanded, unlocking position and a radially contracted locking position, which may have an interference fit. In certain embodiments, the lock ring 160 may be split about its circumference so as to normally expand outwardly to its unlocking position. In certain embodiments, the lock ring 160 may include segments joined to one another to cause it to normally assume a radially outward position, but be collapsible to contractible position.

A cam ring 162 may be disposed about the lock ring 160 and may include inner cam surfaces that can slide over surfaces of the lock ring 160. The cam surfaces of the cam ring 162 may provide a means of forcing the lock ring 160 inward to a locked position. The cam ring 162 may include an upper member 162A and a lower member 162B with corresponding lugs 162A' and 162B'. The upper member 162A and the lower member 162B may be configured as opposing members. The cam ring 162 may be configured so that movement of the upper member 162A and the lower member 162B toward each other forces the lock ring 160 inward to a locked position via the inner cam surfaces of the cam ring 162.

The riser joint connector 104 may include one or more locking members 164. A given locking member 164 may be adapted to extend through a portion of the cam ring 162 to maintain the upper member 162A and the lower member 162B in a locking position where each has been moved toward the other to force the lock ring 160 inward to a locked position. The locking member 164 may include a splined portion 164A and may extend through a flange 152A of the upper tubular assembly 152. The locking member 164 may include a retaining portion 164B, which may include but not be limited to a lip, to abut the upper member 162A. The locking member 164 may include a tapered portion 164C to fit a portion of the upper member 162A. The locking member 164 may include a threaded portion 164D to engage the lower member 162B via threads.

Some embodiments of the riser joint connector 104 may include a secondary locking mechanism, in addition to the cam ring 162 and the lock ring 160. One such embodiment is illustrated in operation in FIGS. 14A-14D. As illustrated, the riser joint connector 104 may include the upper tubular assembly 152 having the flange 152A, the lower tubular assembly 154 having the flange 154A, the lock ring 160, the cam ring 162, and a secondary locking mechanism 210 disposed on the cam ring 162. The secondary locking mechanism 210 may include an outer solid (i.e., continuous) ring 212 with an engagement profile 214 and a split inner ring 216 having a complementary (i.e., matching) engagement profile 218. In the illustrated embodiment, these engagement profiles 214 and 218 may include rows of interlocking teeth. The outer ring 212 may be disposed on and coupled to the upper member 162A of the cam ring 162 while the split inner ring 216 is disposed on and coupled to the lower member 162B of the cam ring 162. In other embodiments, the outer ring 212 may be disposed on and coupled to the lower member 162B of the cam ring 162 while the split inner ring 216 is disposed on and coupled to the upper member 162A of the cam ring 162.

Figure 14A:
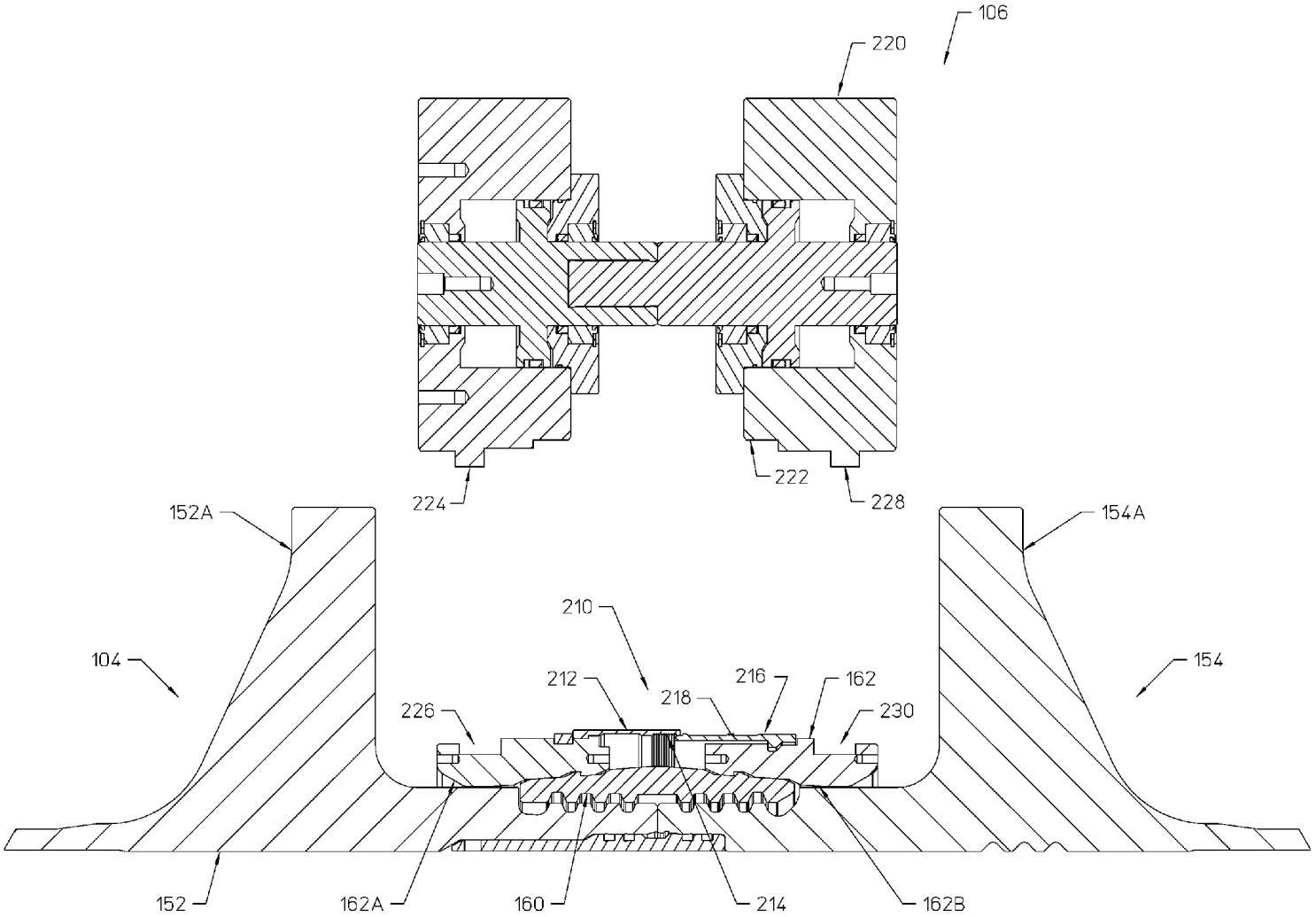
FIGS. 14A-14D show a cross-sectional view of a connector actuation tool being used to lock a connector assembly with a secondary lock, in accordance with certain embodiments of the present disclosure.

As illustrated in FIG. 14A, the split inner ring 216 may be coupled to the cam ring 162 such that the split inner ring 216 is collapsible toward the cam ring 162. For example, the split inner ring 162 may be coupled to the cam ring 162 via a spring or other biasing member that may be compressed in order to selectively collapse the split inner ring 216. In some embodiments, the connector actuation tool 106 may include a manipulator section 220 (similar to clamping tool 135 described above) with a built in shoulder 222 for collapsing the split inner ring 216. When the manipulator sections 220 of the connector actuation tool 106 are actuated toward the riser joint connector 104, the shoulder 222 on each of the manipulator sections 220 may contact the split inner ring 216 and apply a radial force inward. This radial force from the shoulder 222 of the manipulator section 220 may collapse the split inner ring 216 against the cam ring 162. This collapse of the split inner ring 216 is illustrated in detail in FIG. 14B.

Figure 14B:
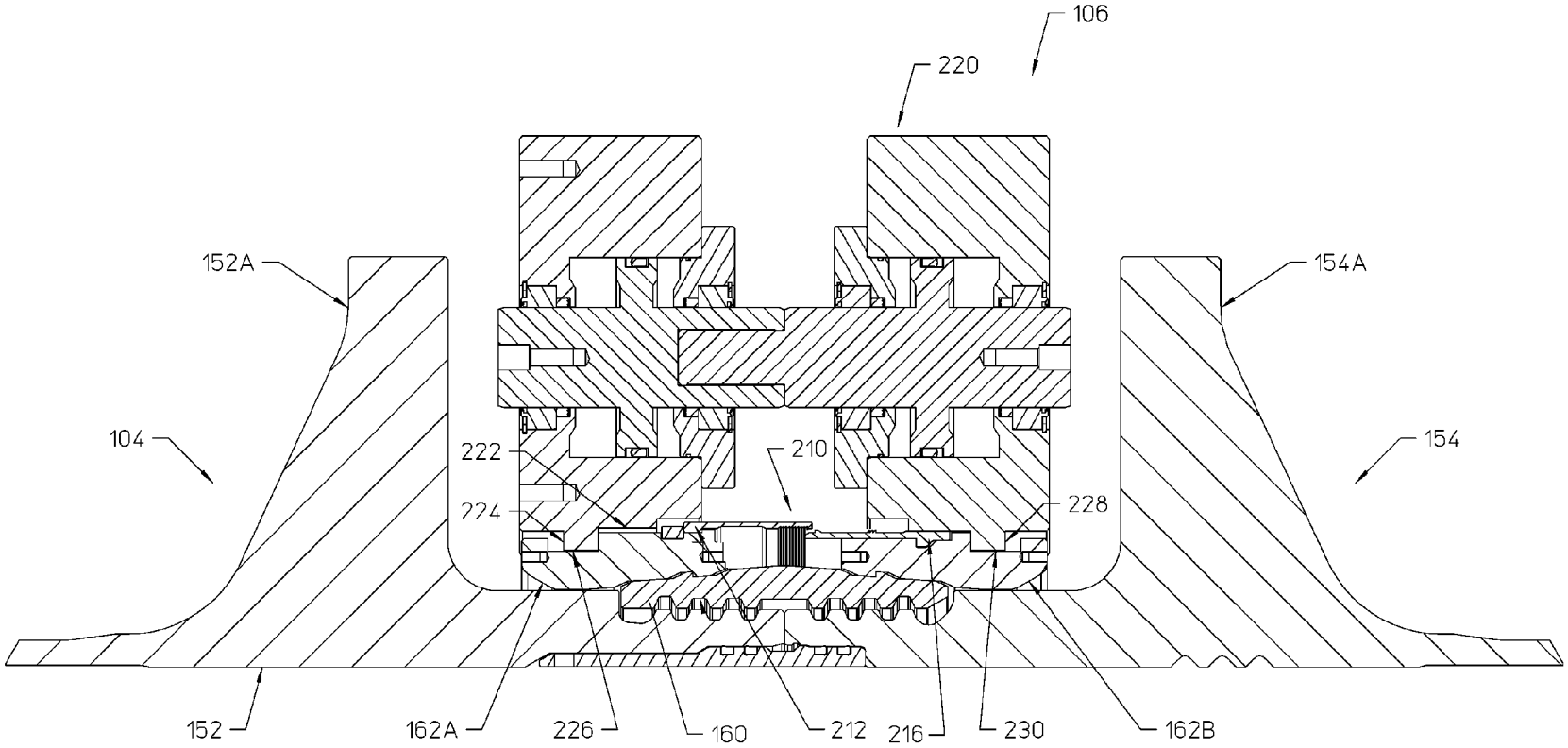
Figure 14C:
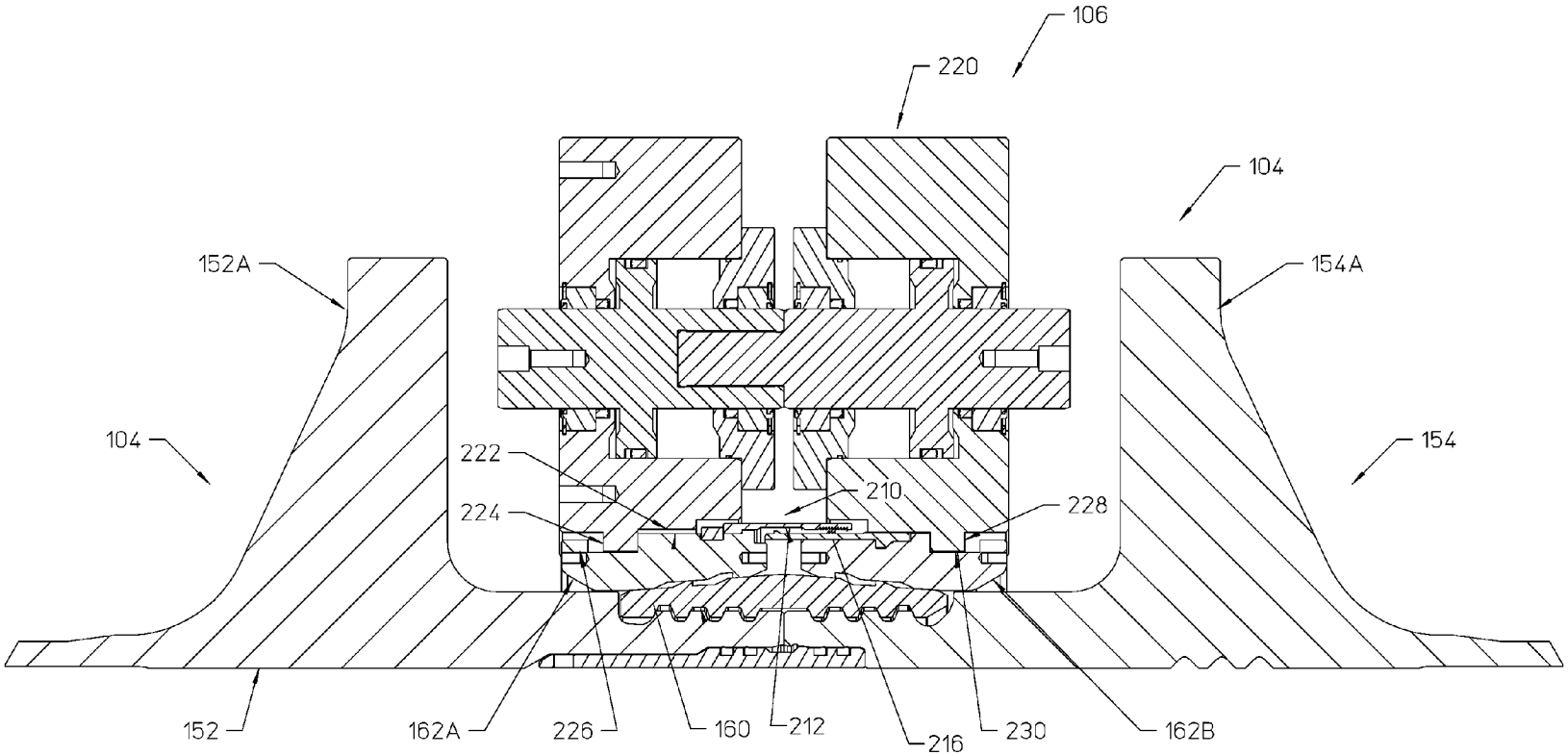

Upon its collapse, the split inner ring 216 may have a smaller outer diameter than the outer ring 212, as shown in FIG. 14B. At this point, the manipulator section 220 may be engaged with the cam ring 162. For example, the illustrated manipulator section 220 may include a projection 224 to engage a depression 226 formed in the upper member 162A of the cam ring 162, as well as a projection 228 to engage a depression 230 formed in the lower member 162B of the cam ring 162. In other embodiments, different types of engagement features may be used at this interface (e.g., piston sections of the manipulator 220 to be engaged with lugs on the cam ring 162). Once engaged with the cam ring 162, the manipulator section 220 may be actuated to force the cam ring members axially toward one another. As shown in FIG. 14C, this movement of the cam ring members 162A and 162B toward each other may be performed without the split inner ring 216 contacting the outer ring 212 of the secondary locking mechanism (e.g., due to the difference in outer diameter of the collapsed inner ring 216 and inner diameter of the outer ring 212).

Once the manipulator section 220 actuates the cam ring members 162 together, this locks the two riser flanges 152A and 154A together via the riser joint connector 104. As described above, for example, the cam ring members 162A and 162B may force the lock ring 160 into engagement with both the upper tubular assembly 152 and the lower tubular assembly 154. As shown in FIG. 14C, the cam ring members 162 may be positioned relative to one another such that the outer ring 212 and the split inner ring 216 of the secondary locking mechanism 210 are overlapping each other (without touching). Thus, in this position the split inner ring 216 may be disposed at least partially inside the outer ring 212.

Figure 14D:
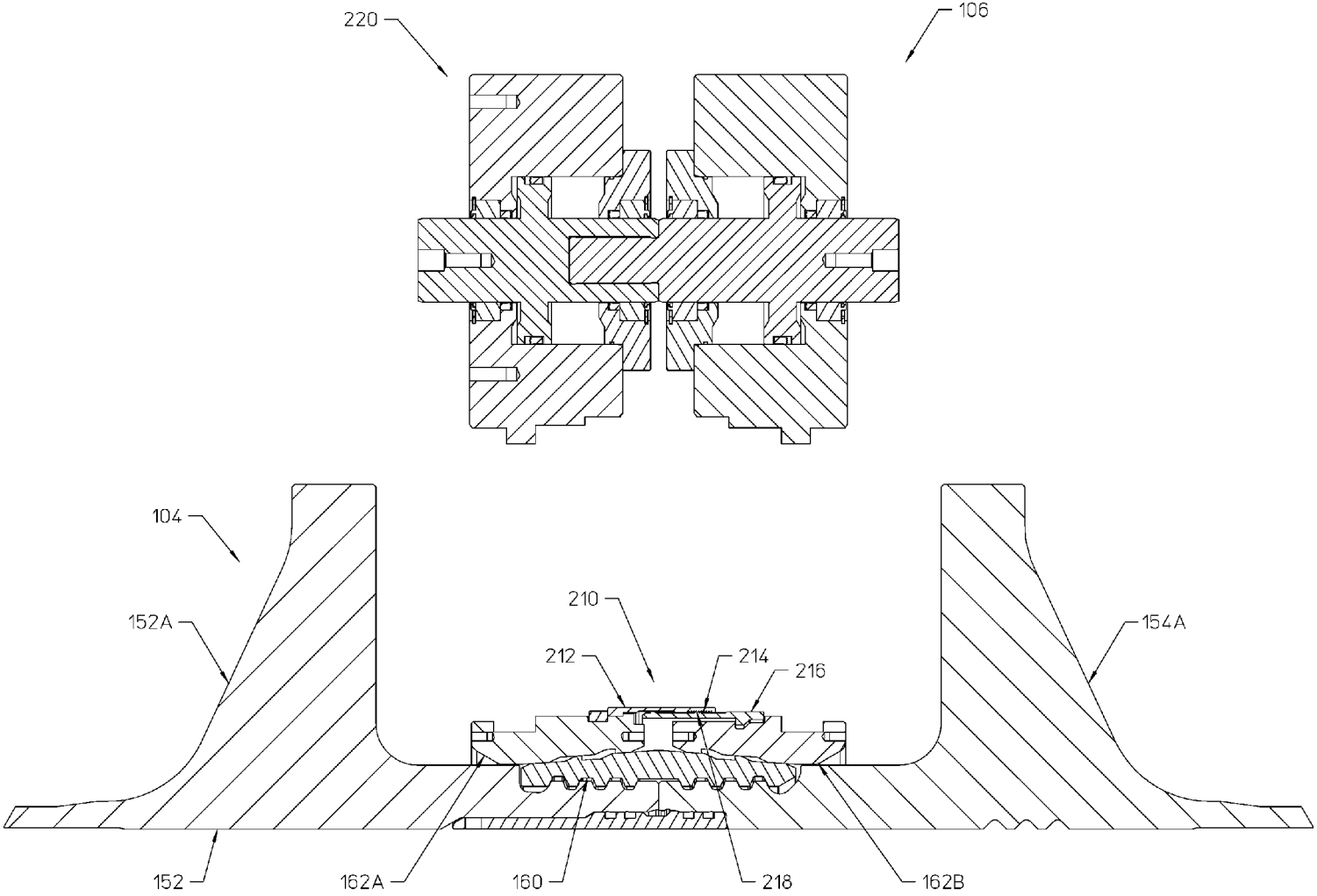

When the manipulator sections 220 are retracted from the riser joint connector 104, the split inner ring 216 may expand back outward (e.g., via a biasing feature) to engage with the outer ring 212, as shown in FIG. 14D. The split inner ring 216 may be forced into a locking profile of the outer ring 212 (e.g., by seating the profile 218 into the corresponding profile 214), thereby closing the secondary locking mechanism 210 to lock the riser joint connector 104 in place. The secondary locking mechanism 210 may effectively lock the riser joint connector 104 in place such that the lock ring 160 cannot disengage with the tubular assemblies 152 and 154 in response to vibrations. Thus, the secondary locking mechanism 210 may ensure that the riser joint connector 104 does not unlock due to vibrations or other external forces experienced at the connection.

As described above, the secondary locking mechanism 210 of FIGS. 14A-14D may be closed to lock the riser joint connector 104 via the same actuation tool 106 (e.g., manipulator 220) used to actuate the primary cam ring 162 and lock ring 160 into place. This enables a second (redundant) lock to be established between the tubular assemblies 152 and 154 without the use of an additional manipulator tool for locking/unlocking the secondary locking mechanism 210. The use of such an additional tool could lead to undesirable system complexity. For example, other tools for actuating secondary locks might use ratcheting mechanisms to close the second lock, and such tools can be difficult to manufacture, use an undesirable amount of locking force, and wear relatively easy. The illustrated secondary locking mechanism 210, however, utilizes a simpler, more reliable lock design that can be actuated using a simple mechanical shoulder built into the manipulator section 220.

Turning back to FIG. 4, the riser joint connector 104 may include one or more auxiliary lines 166. For example, the auxiliary lines 166 may include one or more of hydraulic lines, choke lines, kill lines, and boost lines. The auxiliary lines 166 may extend through the flange 152A and a flange 154A of the lower tubular assembly 154. The auxiliary lines 166 may be adapted to mate between the flanges 152A, 154A, for example, by way of a stab fit.

The riser joint connector 104 may include one or more connector orientation guides 168. A given connector orientation guide 168 may be disposed about a lower portion of the riser joint connector 104. By way of example without limitation, the connector orientation guide 168 may be coupled to the flange 154A. The connector orientation guide 168 may include one or more tapered surfaces 168A formed to, at least in part, orient at least a portion of the riser joint connector 104 when interfacing one of the dog assemblies (e.g., 114 of FIGS. 3A and 3B). When the dog assembly 114 described above contacts one or more of the tapered surfaces 168A of the connector orientation guide 168, the one or more tapered surfaces 168A may facilitate axial alignment and/or rotational orientation of the riser joint connector 104 by biasing the riser joint connector 104 toward a predetermined position with respect to the dog assembly. In certain embodiments, the connector orientation guide 168 may provide a first stage of an orientation process to orient the lower tubular assembly 154.

The riser joint connector 104 may include one or more orientation guides 170. In certain embodiments, the one or more orientation guides 170 may provide a second stage of an orientation process. A given orientation guide 170 may be disposed about a lower portion of the riser joint connector 104. By way of example without limitation, the orientation guide 170 may be formed in the flange 154A. The orientation guide 170 may include a recess, cavity or other surfaces adapted to mate with a corresponding guide pin 172 (depicted in FIG. 5).

Figure 5:
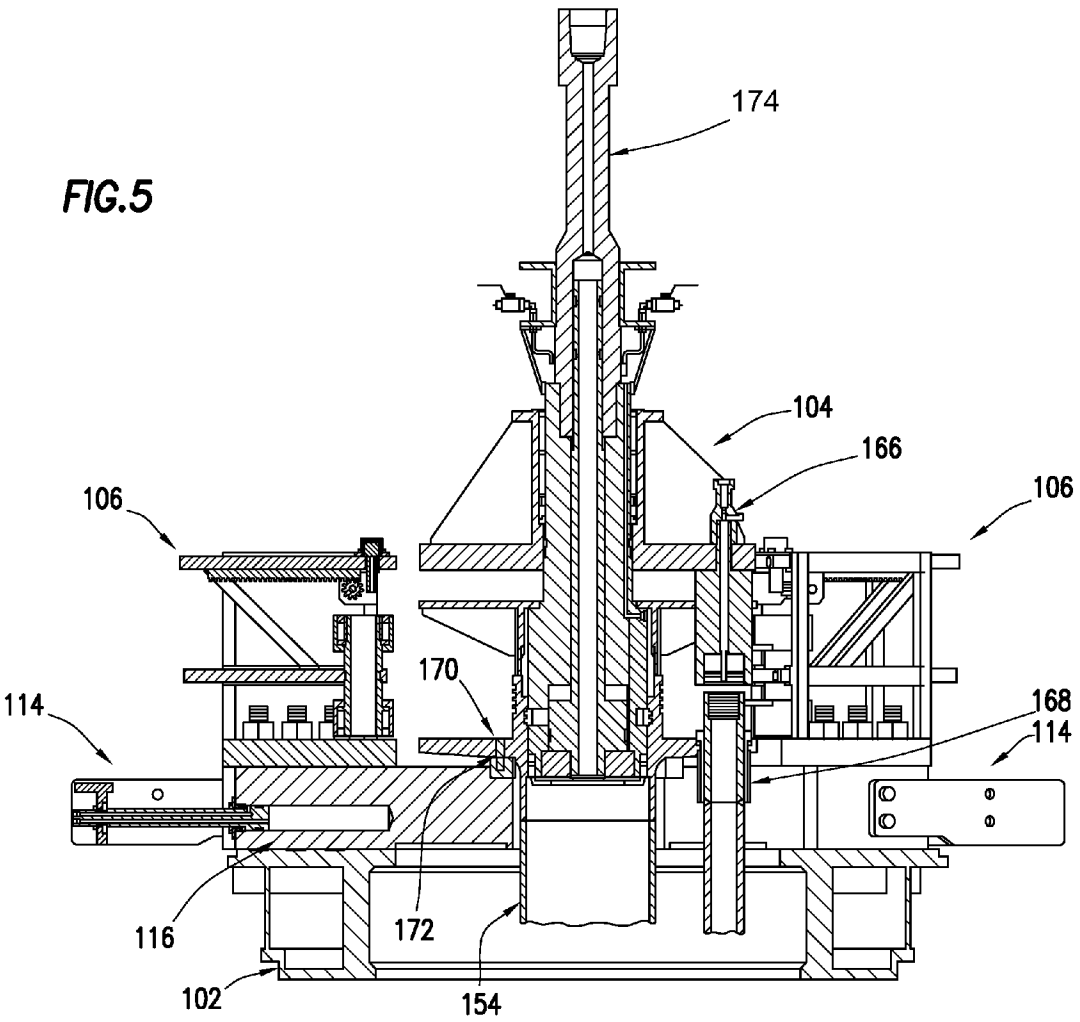
FIG. 5 shows a cross-sectional view of landing a riser section, which may include the lower tubular assembly, in the spider assembly, in accordance with certain embodiments of the present disclosure.

FIG. 5 shows a cross-sectional view of landing a riser section, which may include the lower tubular assembly 154, in the spider assembly 102, in accordance with certain embodiments of the present disclosure. In the example landed state shown, the dogs 116 have been extended to retain the tubular assembly 154, and the two-stage orientation features have oriented the lower tubular assembly 154. Specifically, the connector orientation guide 168 has already facilitated axial alignment and/or rotational orientation of the lower tubular assembly 154, and one or more of the dog assemblies 114 may include a guide pin 172 extending to mate with the orientation guide 170 to ensure a final desired orientation.

A running tool 174 may be adapted to engage, lift, and lower the lower tubular assembly 154 into the spider assembly 102. In certain embodiments, the running tool 174 may be adapted to also test the auxiliary lines 166. For example, the running tool 174 may pressure test choke and kill lines coupled below the lower tubular assembly 154.

In certain embodiments, one or more of the running tool 174, the tubular assembly 154, and auxiliary lines 166 may be fitted with one or more sensors (not shown) to detect position, orientation, pressure, and/or other parameters associated with said components. Corresponding signals may be transferred to an information handling system at any suitable location on the vessel or platform by any suitable means, including wired or wireless means.

Figure 6:
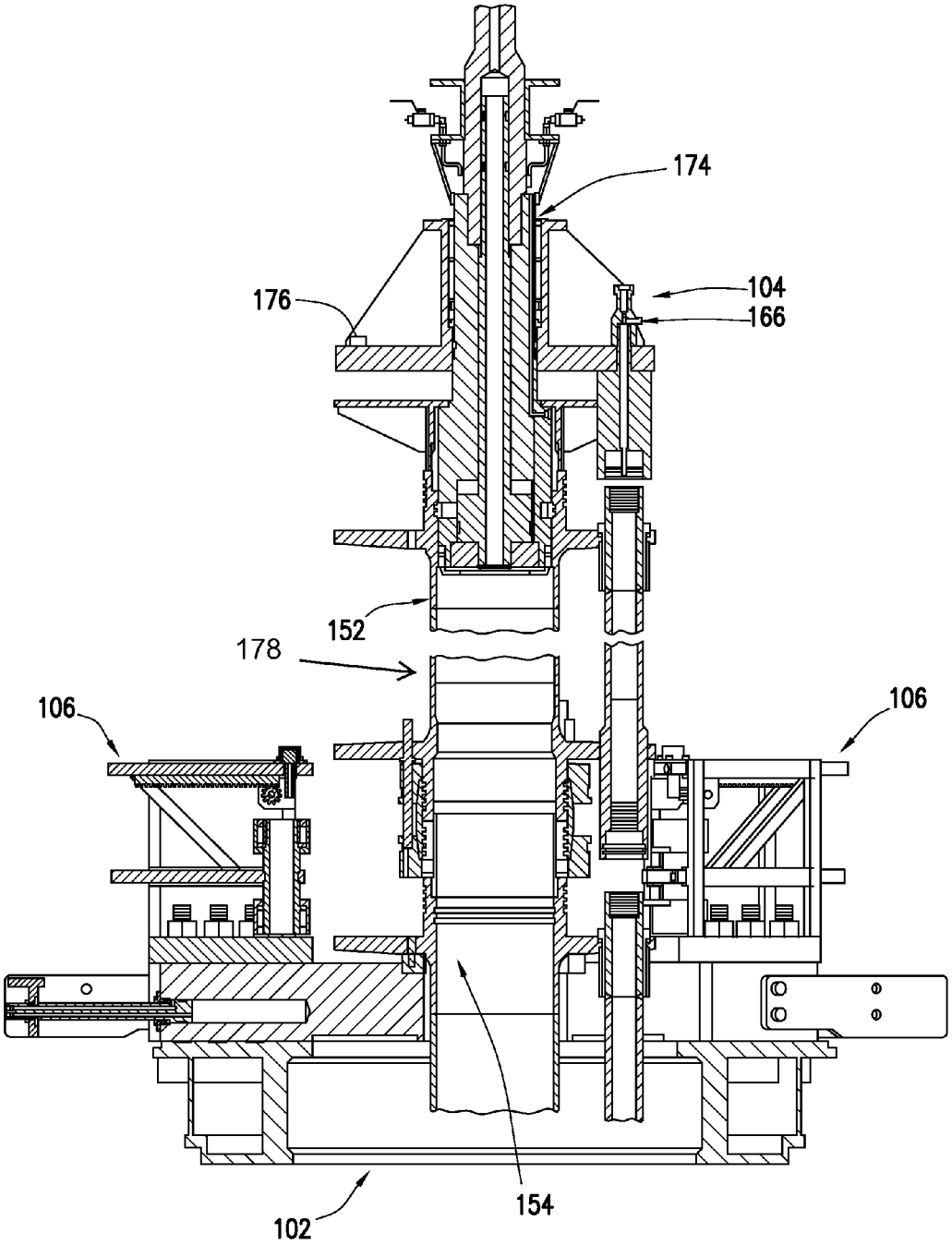
FIG. 6 shows a cross-sectional view of running the upper tubular assembly to the landed lower tubular assembly, in accordance with certain embodiments of the present disclosure.

FIG. 6 shows a cross-sectional view of running the upper tubular assembly 152 to the landed lower tubular assembly 154, in accordance with certain embodiments of the present disclosure. The running tool 174 may be used to engage, lift, and lower the upper tubular assembly 152. The upper tubular assembly 152 may be lowered onto a stab nose 178 of the lower tubular assembly 154.

In certain embodiments, as described in further detail below, the running tool 174 may include one or more sensors 176 to facilitate proper alignment and/or orientation of the upper tubular assembly 152. The one or more sensors 176 may be located at any suitable positions on the running tool 174. In certain embodiments, the tubular member 152 may be fitted with one or more sensors (not shown) to detect position, orientation, pressure, weight, and/or other parameters of the tubular member 152. Corresponding signals may be transferred to an information handling system at any suitable location on the vessel or platform by any suitable means, including wired or wireless means.

Figure 7:
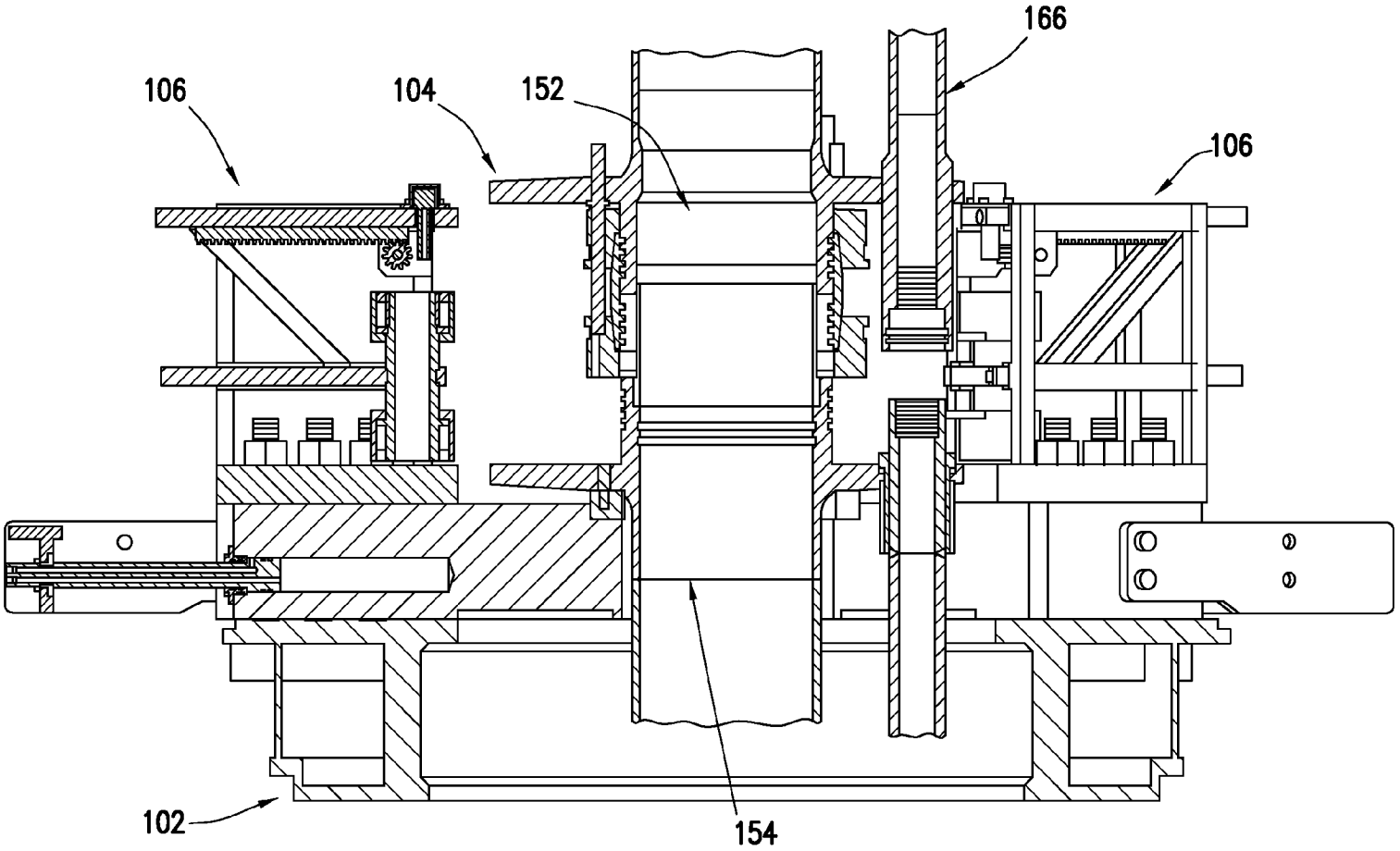
FIG. 7 shows a cross-sectional view of orienting an upper tubular assembly with respect to a lower tubular assembly, in accordance with certain embodiments of the present disclosure.

FIG. 7 shows a cross-sectional view of orienting the upper tubular assembly 152 with respect to lower tubular assembly 154, in accordance with certain embodiments of the present disclosure. It should be understood that orienting the upper tubular assembly 152 may be performed at any suitable stage of the lowering process, or throughout the lower process.

Figure 8:
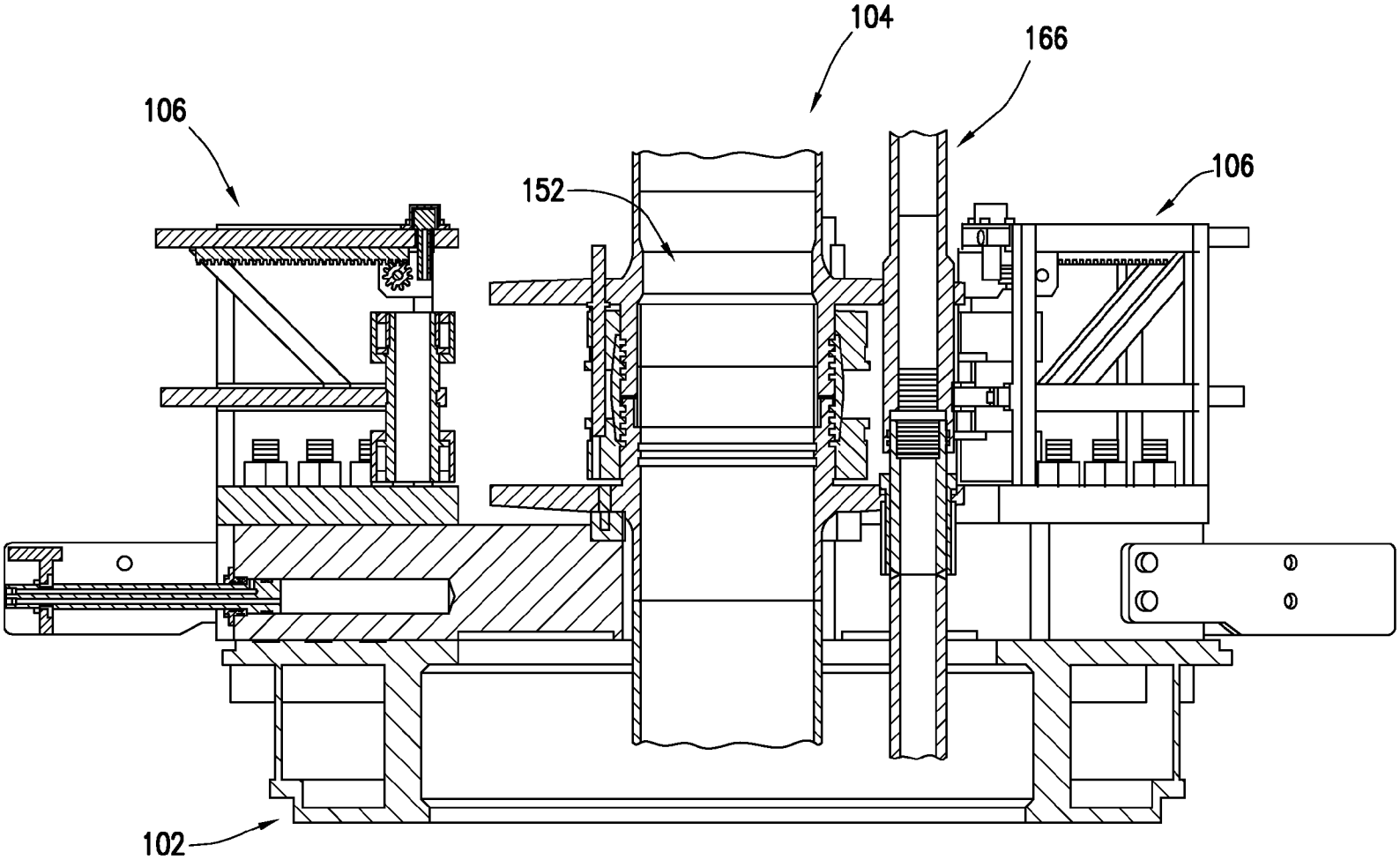
FIG. 8 shows a cross-sectional view of an upper tubular assembly landed, in accordance with certain embodiments of the present disclosure.

FIG. 8 shows a cross-sectional view of the upper tubular assembly 152 landed, in accordance with certain embodiments of the present disclosure.

Figure 9:
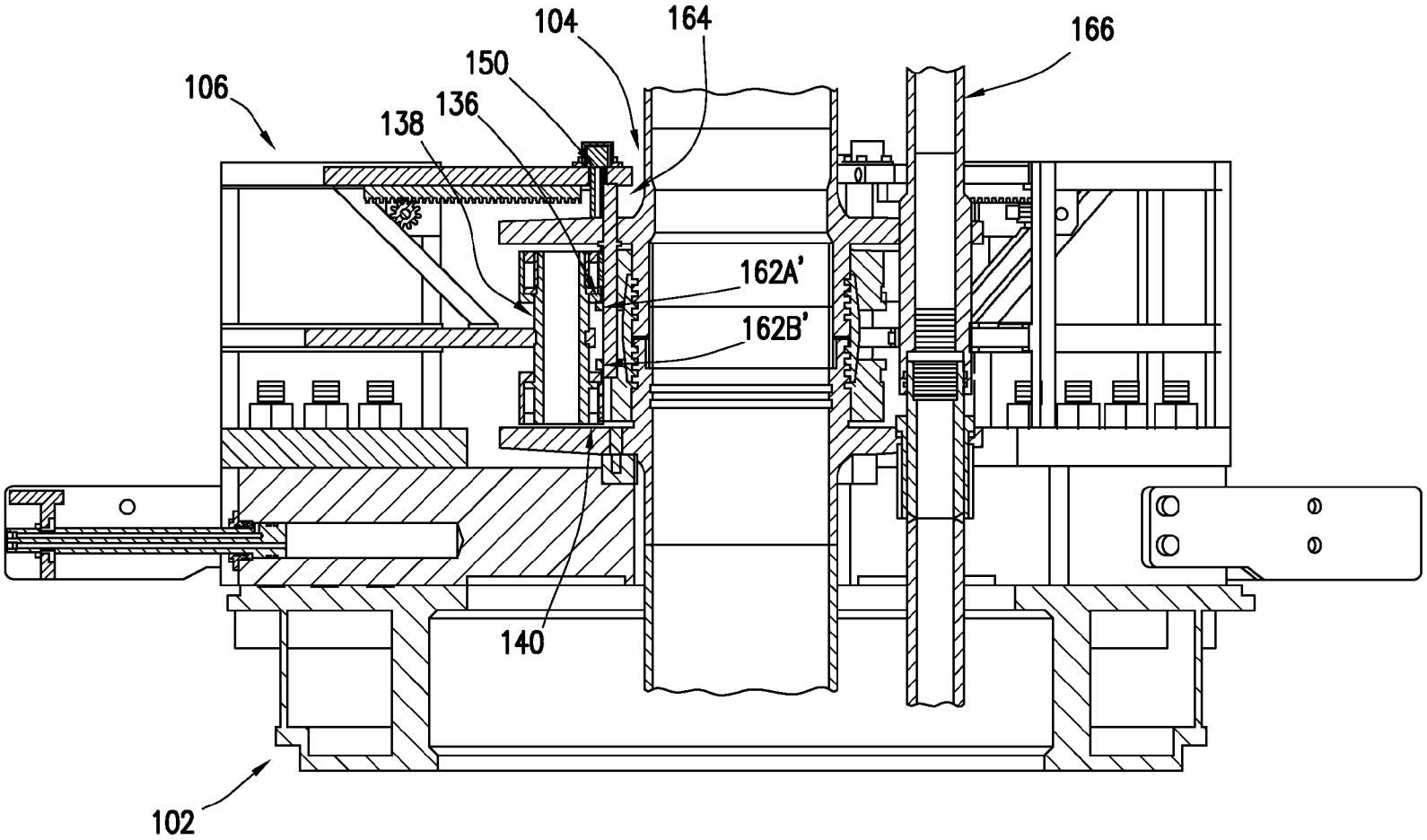
FIG. 9 shows a cross-sectional view of the connector actuation tool engaging a riser joint prior to locking a riser joint, in accordance with certain embodiments of the present disclosure.

FIG. 9 shows a cross-sectional view of the connector actuation tool 106 engaging the riser joint connector 104 prior to locking the riser joint connector 104, in accordance with certain embodiments of the present disclosure. As depicted, the actuation piston mandrel 138 may be extended toward the riser joint connector 104. The upper actuation piston 136 may engage the lug 162A' and/or an adjacent groove of the cam ring 162. Likewise, the lower actuation piston 140 may engage the lug 162B' and/or an adjacent groove of the cam ring 162. The splined member 150 may also be extended toward the riser joint connector 104. As depicted, the splined member 150 may engage the locking member 164. In various embodiments, the actuation piston mandrel 138 and the splined member 150 may be extended simultaneously or at different times.

Figure 10:
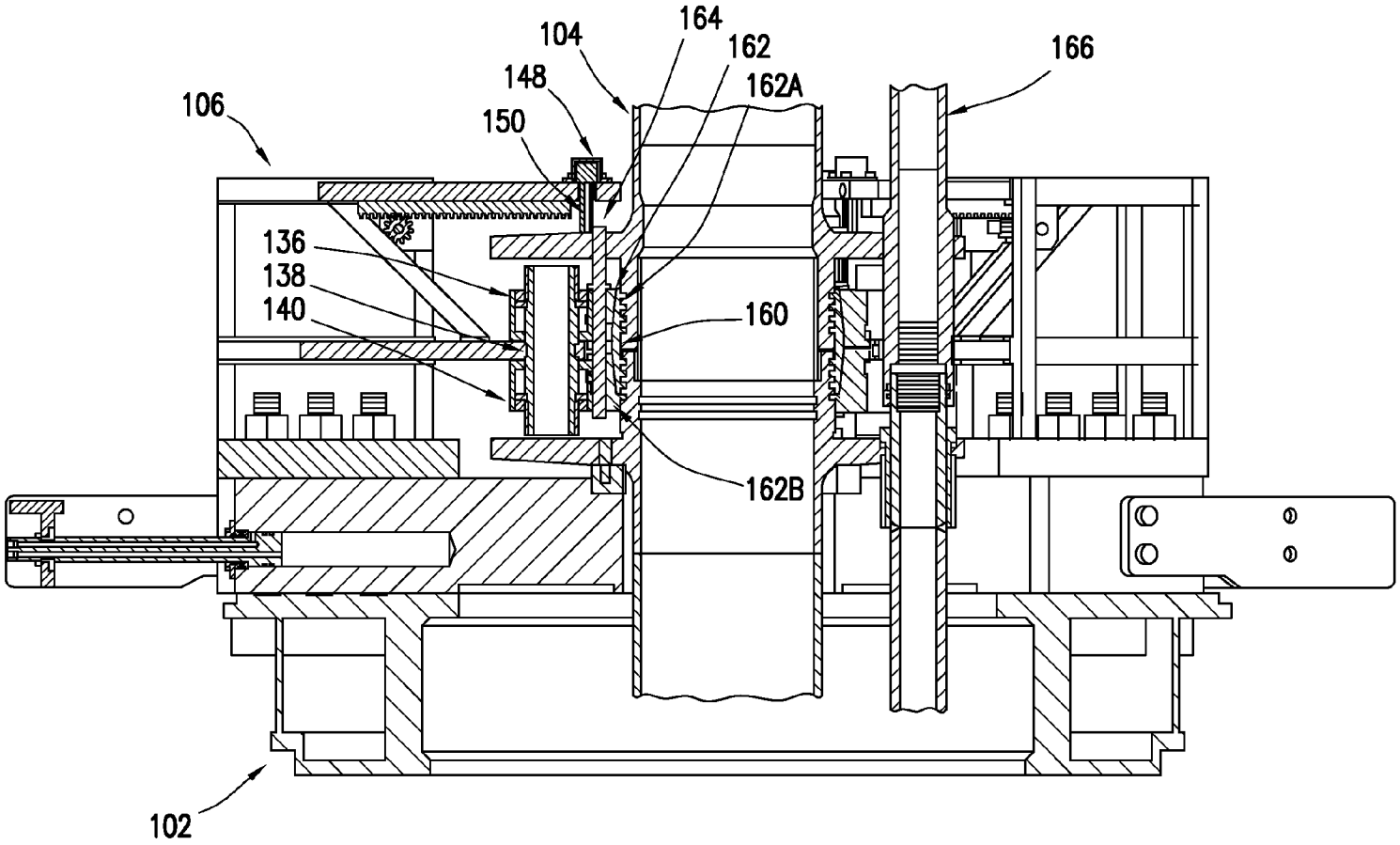
FIG. 10 shows a cross-sectional view of a connector actuation tool locking a riser joint, in accordance with certain embodiments of the present disclosure.

FIG. 10 shows a cross-sectional view of the connector actuation tool 106 locking the riser joint connector 104, in accordance with certain embodiments of the present disclosure. As depicted, with suitable hydraulic pressure having been applied to the upper and lower actuation pistons 136, 140, the upper and lower actuation pistons 136, 140 moved longitudinally along the actuation piston mandrel 138 toward a middle portion of the actuation piston mandrel 138. The upper member 162A and the lower member 162B of the cam ring 162 are thereby forced toward one another, which may act as a clamp that in turn forces the lock ring 160 inward to a locked position via the inner cam surfaces of the cam ring 162. As depicted, the locking member 164 may be in a locked position after the motor 148 has driven the splined member 150, which in turn has driven the locking member 164 into the locked position to lock the cam ring 162 in a clamped position. In various embodiments, the locking member 164 may be actuated into the locked position as the cam ring 162 transitions to a locked position or at a different time.

Figure 11:
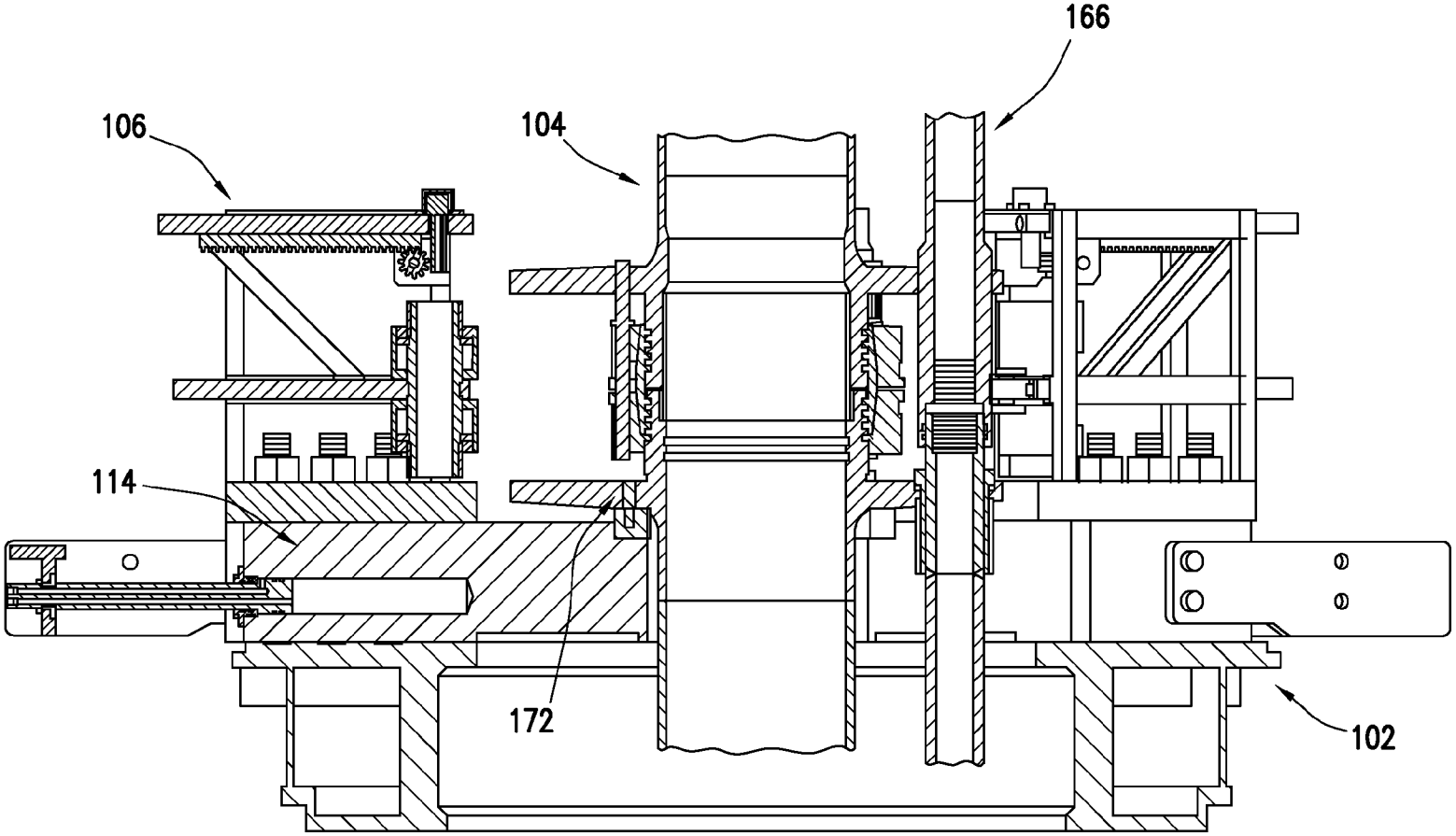
FIG. 11 shows a cross-sectional view of the connector actuation tool retracted, in accordance with certain embodiments of the present disclosure.

FIG. 11 shows a cross-sectional view of the connector actuation tool 106 retracted, in accordance with certain embodiments of the present disclosure. From that position, the running tool 174 (depicted in previous figures) may engage the riser joint connector 104 and lift the riser joint connector 104 away from the guide pin 172. The dogs 114 may be retracted, the riser joint connector 104 may be lowered passed the spider assembly 102, and the process of landing a next lower tubular may be repeated. It should be understood that a dismantling process may entail reverses the process described herein.

Some embodiments of the riser joint connector 104 may feature a modular design that enables a coupling used to lock the tubular assemblies 152/154 together to be selectively removable from the tubular assemblies. An embodiment of one such modular riser joint connector assembly 250 is illustrated in FIGS. 16A-16D. In this embodiment, the riser joint connector assembly 250 includes a coupling 252 that can be selectively disposed on or removed from one or both of the upper and lower tubular assemblies. In the illustrated embodiment, the coupling 252 is shown being selectively engaged and disengaged with the upper tubular assembly 152. The coupling 252 may include at least the lock ring 160 and the cam ring 162. In some embodiments, the coupling 252 may include additional components such as, for example, the secondary locking mechanism 210 described above with reference to FIGS. 14A-14D. Other components or arrangements of such components used to lock adjacent tubular assemblies together may form the modular coupling 252 in other embodiments.

Figure 16A:
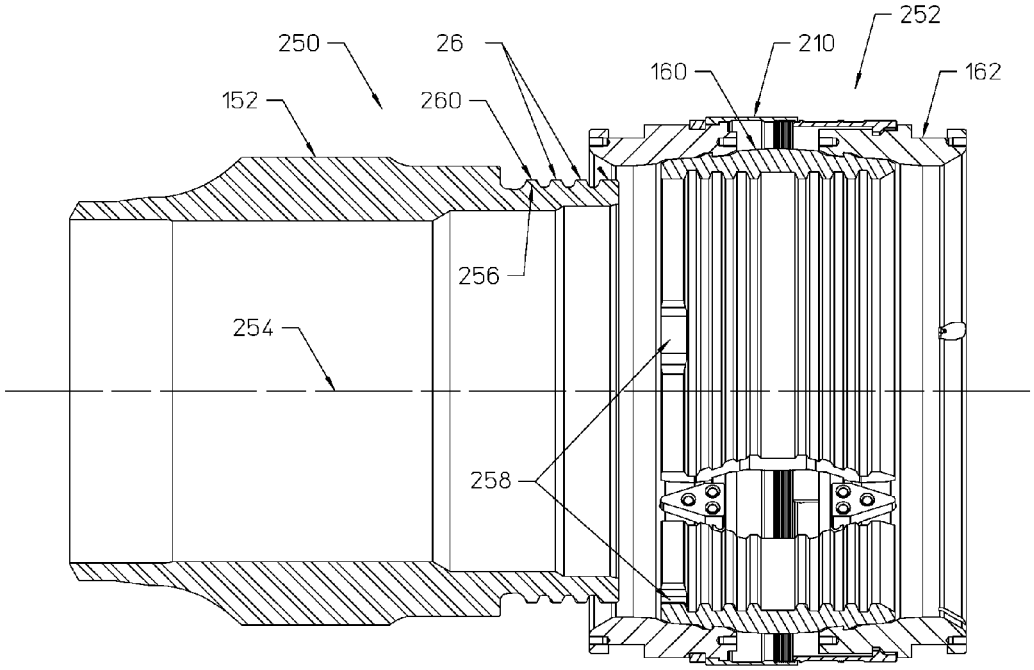
FIGS. 16A-16D show cross-sectional views of a riser joint being selectively engaged and disengaged with a removable connector assembly, in accordance with certain embodiments of the present disclosure.

To position and secure the coupling 252 onto the upper tubular assembly 152, the coupling 252 may be positioned proximate an end of the upper tubular assembly 152, as shown in FIG. 16A. The coupling 252 may be rotated about an axis 254 to align a projection 256 extending radially outward from the upper tubular assembly 152 into a corresponding slot 258 formed through the coupling 252. As illustrated, the coupling 252 may be equipped with multiple such slots 258 to accommodate a number of complementary projections 256 extending from the upper tubular assembly 152. In the illustrated embodiment, these projections 256 may include an extended tooth or extended portions of a tooth 260 used to engage the lock ring 160 when the lock ring 160 is sealed onto the tubular assembly 152. As illustrated, the other teeth 262 on the tubular assembly 152 that are used to engage the corresponding teeth on the lock ring 160 may be shorter (i.e., extending a shorter distance radially outward) than the extended tooth 260. In other embodiments, the tubular assembly 152 may include two or more extended teeth 260 to be received into the slots 258 formed within the coupling 252.

Figure 15:
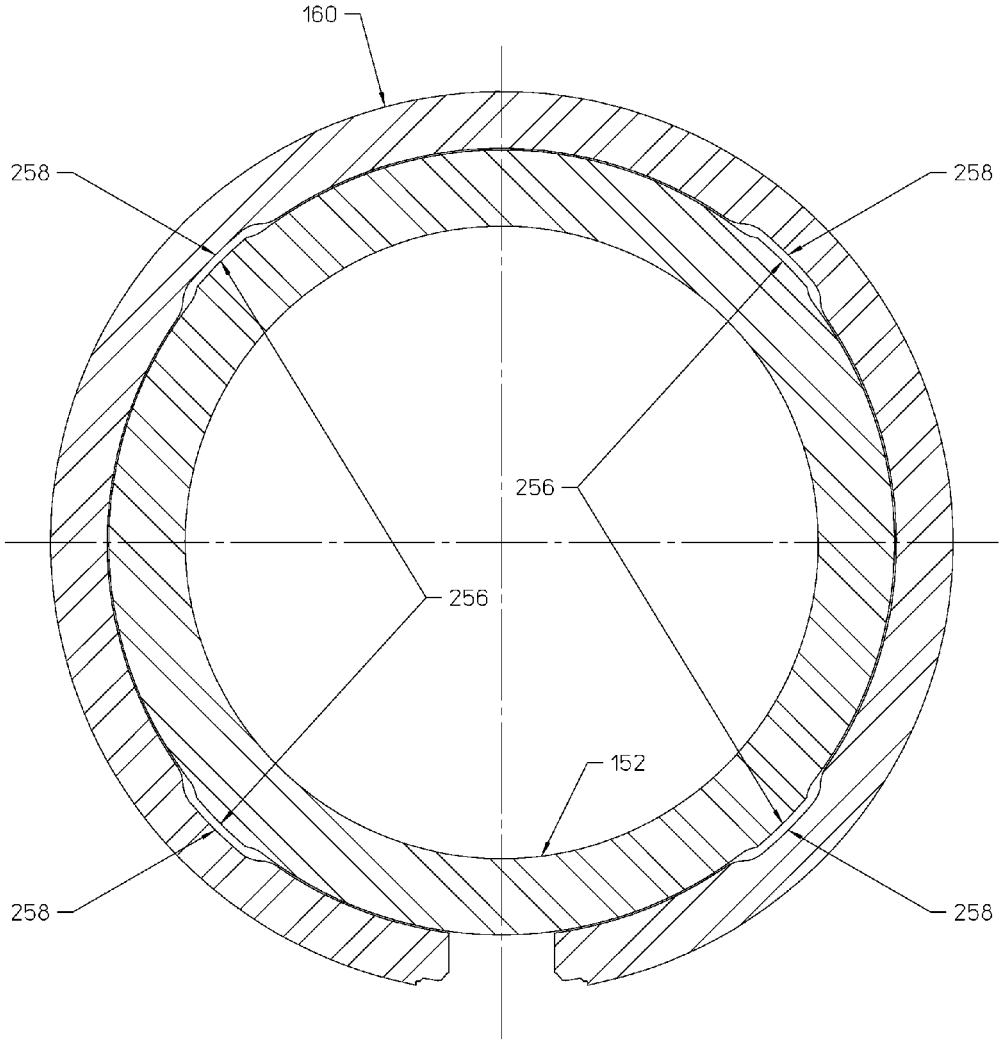
FIG. 15 shows a cross-sectional view of an interface between a riser joint and a removable connector assembly, in accordance with certain embodiments of the present disclosure.
Figure 16B:
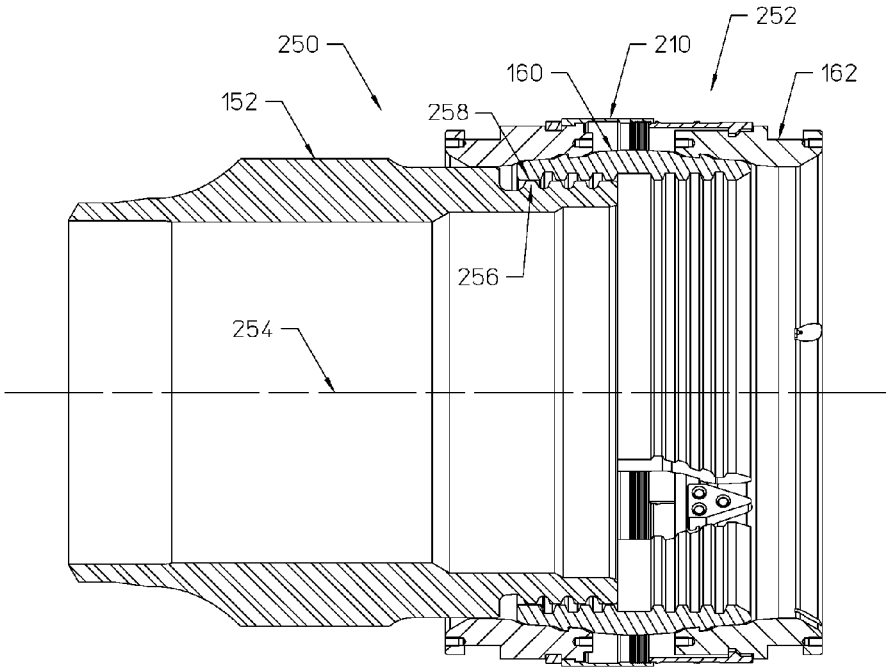
Figure 16C:
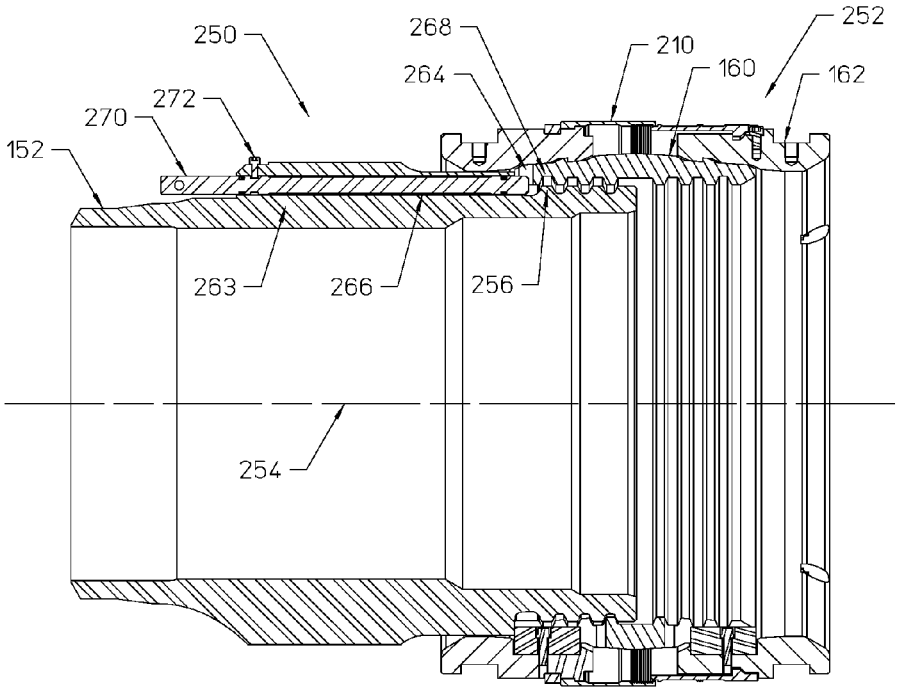

FIG. 15 illustrates a cross-sectional view of the interface between the projections 256 of the tubular assembly 152 and the corresponding slots 258 in the coupling 252. As illustrated, the slots 258 may be formed in the lock ring 160. FIG. 16B illustrates the extended tooth projection 256 being positioned within the corresponding slot 258 of the lock ring 160. Once the projection 256 is received through the slot 258 in the coupling 252, the coupling 252 may be moved further onto the tubular assembly 152 such that the projection 256 moves past the slot 258 and into the engagement portion of the lock ring 160. The "engagement portion" of the lock ring may include the toothed profile of the locking mechanism 160, as illustrated. That is, the coupling 252 may be positioned over the tubular assembly 152 such that the projection 256 enters the coupling 252 through the appropriately oriented slot 258 and then passes through the slot 258 into a toothed profile that enables rotation of the coupling 252 with respect to the tubular assembly 152.

From this position, the coupling 252 may be rotated about the axis 254, with respect to the tubular assembly 152, to align other components of the coupling 252 and the tubular assembly 152. For example, in the illustrated embodiment of FIG. 16C, the coupling 252 may be rotated with respect to the tubular assembly 152 to align a portion 263 of the tubular assembly 152 with another slot 264 formed through the coupling 252. The slot 264 may be radially offset from the other one or more slots 258 formed through the lock ring 160. Similarly, the portion 263 of the tubular assembly 152 may be radially offset from the one or more projections 256 extending from the tubular assembly 152. In the illustrated embodiment, the portion 263 of the tubular assembly 152 includes a channel or slot 266 through which a locking mechanism may be received, and a shortened section 268 of the lock ring 160 may define the additional slot 264 within the coupling 252.

Once the coupling 252 is rotated so that the projection 256 is no longer aligned with the corresponding slot 258, the coupling 252 is generally secured to the tubular assembly 152. To ensure that the coupling 252 stays securely fastened onto the tubular assembly 152, the modular riser joint connector assembly 250 may further include a removable locking pin 270 that can be disposed at least partially through the portion 263 of the tubular assembly 152 and through the slot 264. This locking pin 270 is disposed in the locking position in the illustrated embodiment of FIG. 16C. The locking pin 270 may be secured via a retainer bolt 272 disposed through an opening in the tubular assembly 152 and screwed into the locking pin 270. When the locking pin 270 is secured in this position, it may prevent the coupling 252 from rotating with the respect to the tubular assembly 152. Thus, the locking pin 270 may be used to selectively secure the coupling 252 to the end of the tubular assembly 152 as shown.

Figure 16D:
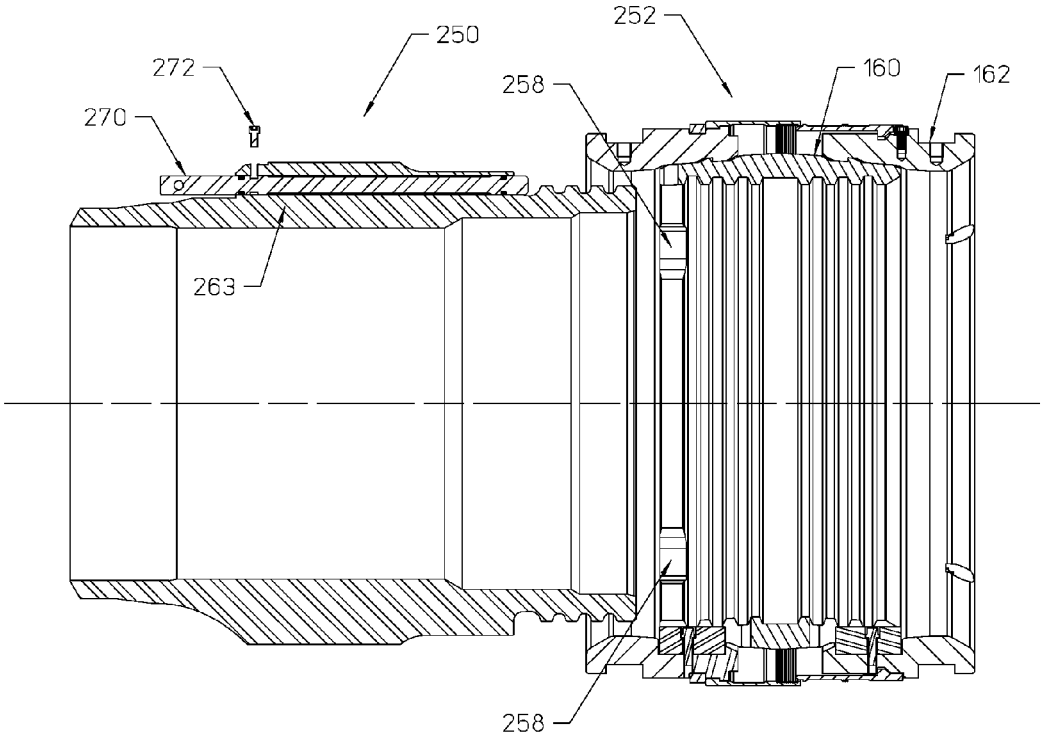

As described above, it is desirable to make the coupling 252 selectively removable from the tubular assembly 152. In the event that the coupling 252 malfunctions during the automated coupling process, an operator may remove the retainer bolt 272 and the locking pin 270, rotate the coupling 252 so that the projections 256 once again align with the slots 258 in the coupling 252, and slide the coupling 252 off the tubular assembly 152. This removal of the locking pin 270 and the coupling 252 is illustrated in FIG. 16D. The defective coupling may then be replaced with a new coupling 252, without an operator having to remove or dispose of the entire tubular assembly 152.

In some embodiments, the coupling 252 may incorporate a spreader wedge to ensure that the cam ring 162 can be opened. This may keep the coupling 252 from becoming stuck in the locked position, so that the coupling 252 may later be removed from the tubular assembly 152 as desired.

The disclosed modular riser joint connector assembly 250 may allow an end user to quickly remove, replace, and/or service the coupling 252. The user would not have to remove the entire tubular assembly 152 along with the coupling 252, since the coupling 252 is removable from the tubular assembly 152. This may save the end user time in performing service, repairs, and replacements of the riser parts. In the event that a flange (e.g., 152A) of the tubular assembly 152 becomes damaged, the coupling 252 may be removed from the unusable tubular assembly 152 and repositioned on a new tubular assembly 152. This may enable the operators to service the riser connections with fewer total parts than would be necessary if the coupling and the tubular assembly were permanently attached.

Figure 17:
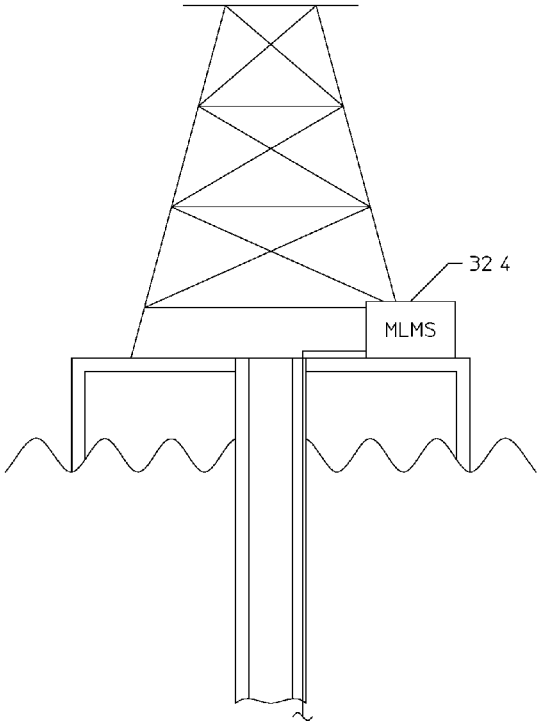
FIG. 17 shows a schematic view of a riser assembly equipped with an external and internal monitoring system, in accordance with certain embodiments of the present disclosure.
Figure 17:
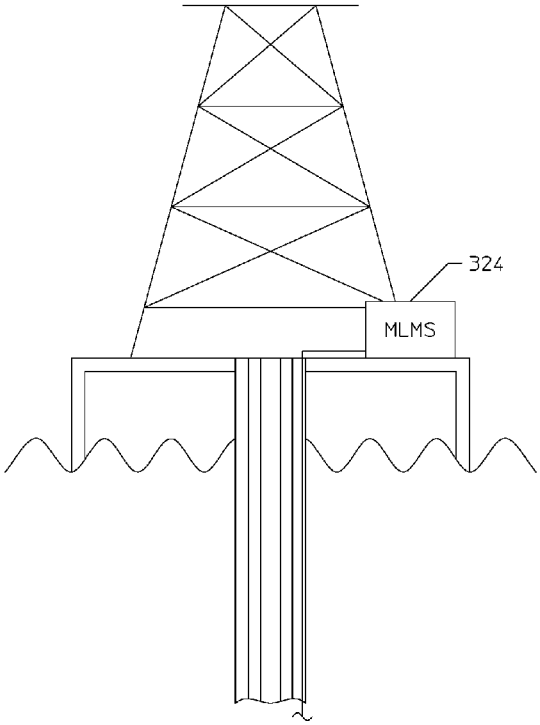
Figure 17:
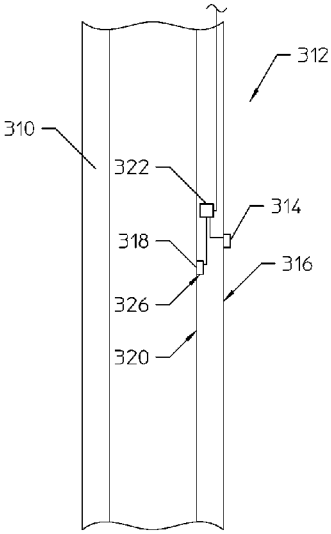

As mentioned above, the tubular assemblies 152/154 and the running tool 174 may include sensors to facilitate orientation and placement of the tubular assemblies 152 and 154 relative to one another. Other sensors may be used throughout the riser system to enable monitoring of various properties of the riser components. For example, FIG. 17 shows a schematic view of a riser assembly 310 that may be equipped with an improved riser monitoring system 312. The riser monitoring system 312 may provide two types of monitoring of the riser assembly 310: external monitoring and internal monitoring.

The external monitoring of the riser assembly 310 may be carried out by external sensors 314 disposed on an outer surface 316 of one or more components of the riser assembly 310. The internal monitoring of the riser assembly 310 may be carried out by internal sensors 318 disposed along an internal bore 320 through one or more components of the riser assembly 310. Although FIG. 17 illustrates a riser assembly 311 having an external sensor 314 and an internal sensor 318, it should be noted that other embodiments of the riser assembly 311 may include just external sensors 314 (one or more), or just internal sensors 318 (one or more), depending on the monitoring needs of the system. A riser communication system 322 may communicate signals indicative of the properties sensed by the riser monitoring system 312 to an information handling system 324 at a suitable location on the vessel or platform. The information handling system 324 may be an operator monitoring system. In some embodiments, the operator monitoring system 324 may include a monitoring/lifecycle management system (MLMS) that helps to track loads on various components of the riser assembly 310, among other things.

Figure 18:
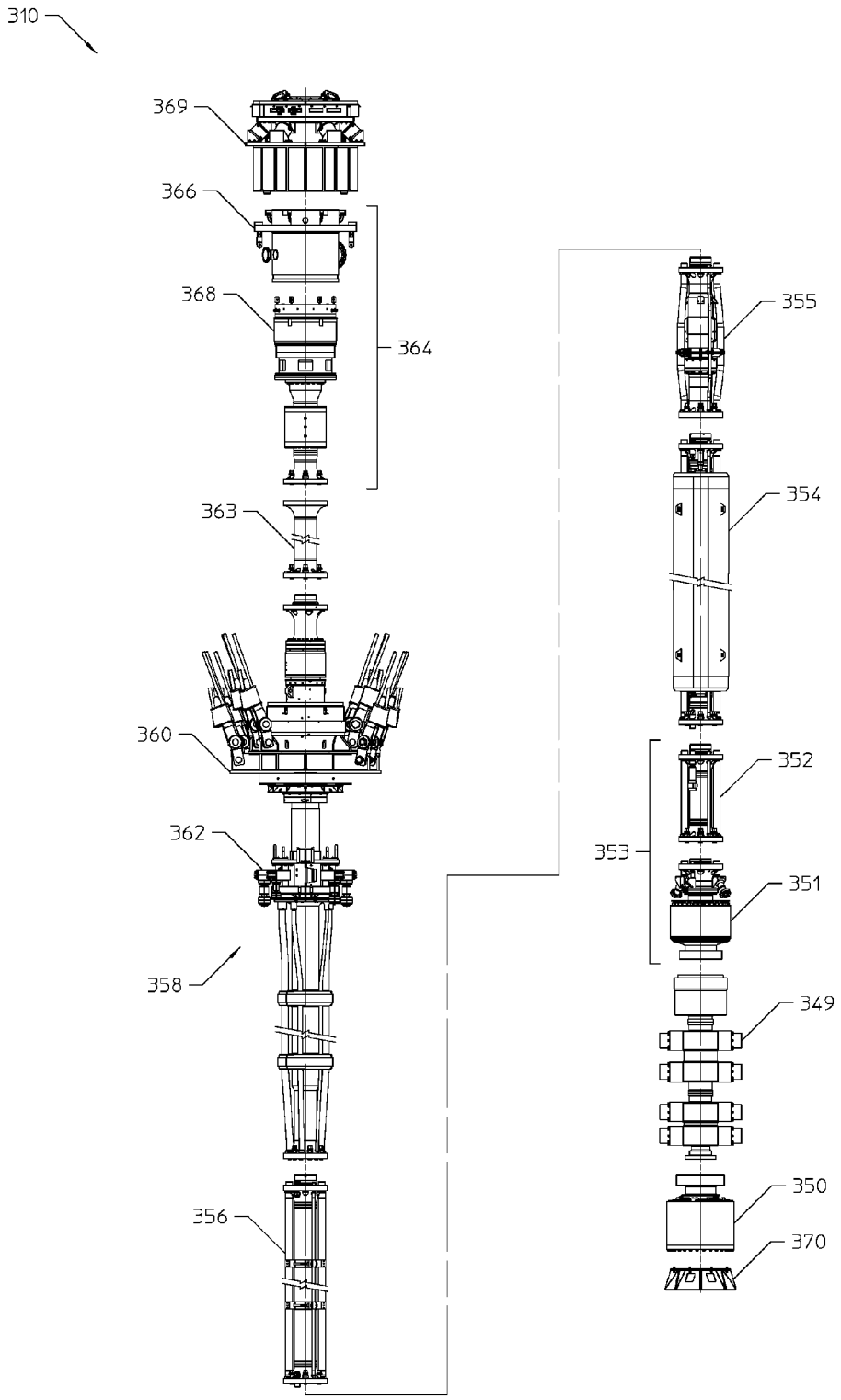
FIG. 18 shows a schematic exploded view of components that make up a riser assembly, in accordance with certain embodiments of the present disclosure.

FIG. 18 illustrates an embodiment of the riser assembly 310, which may include the following equipment: a BOP connector (or wellhead connector) 350, a lower BOP stack 349, a riser extension joint 353 that may include a lower marine riser package (LMRP) 351 and a boost line termination joint 352, one or more buoyant riser joints 354, an auto fill valve 355, one or more bare riser joints 356, a telescopic joint 358 having a tension ring 360 and a termination ring 362, a riser landing joint (or spacer joint) 363, a diverter assembly 364 having a diverter housing 366 and a diverter flex joint 368, and a gimbal mount 369 for the base of the spider assembly 102. As shown, several components of the riser assembly 310 may generally be coupled end to end, or in series, between an upper component (e.g., rig platform) and a lower component (e.g., subsea wellhead 370).

Any of the riser components disclosed herein may be equipped with one or more of the external sensors 314, internal sensors 318, or both. All of the sensors 314 and 318 used throughout the riser assembly 310 may be communicatively coupled to the MLMS 324, which determines and monitors an operating status of the riser assembly 310 based on the sensor feedback.

In some embodiments, the riser assembly 310 may include only some of the components listed above with respect to FIG. 18. In some embodiments, different combinations of the illustrated components may be utilized in the riser assembly 310. In still other embodiments, the riser assembly 310 may include additional components not listed above that may be equipped with sensors for monitoring internal or external properties of the riser assembly 310.

External monitoring of the riser assembly 310 may be performed by the external sensors 314. These external sensors 314 may monitor any of the following aspects of the riser assembly 310: pressures, temperatures, flowrates, stress (e.g., tension, compression, torsion, or bending), strain, weight, orientation, proximity, or corrosion. Other properties may be measured by the external sensors 314 as well. The external sensors 314 may be mounted throughout the riser assembly 310. For example, the external sensors 314 may be mounted to the outer surfaces of various riser joints (e.g., bare riser joints 356 or buoyant riser joints 354), the riser extension joint 352, the telescopic joint 358, the diverter assembly 364, as well as various other components of the riser assembly 310.

Internal monitoring may be performed throughout the riser assembly 310 via the internal sensors 318. These internal sensors 318 may also monitor various properties of the riser assembly 310 such as, for example, pressure, temperatures, flowrates, stress, strain, weight, orientation, proximity, or corrosion. Other properties may be measured as well by the internal sensors 318. The internal sensors 318 may be disposed along the internal bore 320 of the riser assembly 310 (or other positions internal to the riser assembly 310). In some embodiments, the internal sensors 318 may reside inside the various riser joints (e.g., bare riser joints 356 or buoyant riser joints 358), the extension joint 352, the BOP connector 350, as well as various other components of the riser assembly 310.

As illustrated in FIG. 17, the riser assembly components may be constructed such that a cavity 326 is formed in the riser component along the internal bore 320, and the internal sensor 318 is positioned within the cavity such that the sensor 318 is exposed to the internal bore 320 without extending radially into the internal bore 320. That way, the internal sensors 318 lie flat against the wall of the inner bore 320 throughout the riser assembly 310. In some embodiments, the internal sensors may be mounted on the outside of the riser component and penetrate through the wall of the riser component so it can easily be connected to the communication system and still provide internal sensing. This keeps the sensors 318 from interrupting a flow of fluids through the internal bore 320 or interfering with equipment being lowered through the internal bore 320.

Figure 19:
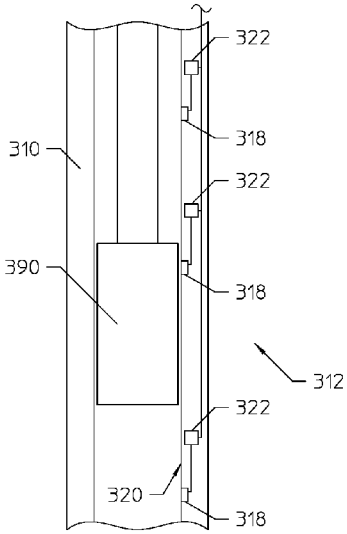
FIG. 19 shows a schematic view of a riser assembly equipped with internal monitoring sensors for detecting movement of a downhole tool through the riser assembly, in accordance with certain embodiments of the present disclosure.

As illustrated in FIG. 19, multiple internal sensors 318 disposed along the internal bore 320 of the riser assembly 310 may monitor trips of downhole tools 390 being lowered or lifted through the riser assembly 310. More specifically, the internal sensors 318 may be used to monitor the travel speed of the tool 390, flowrate of fluid around the tool 390, and the functions of the tool 390. The internal sensors 318 may provide real-time or near real-time feedback via the communication system 322 to the MLMS 324, or may record the data for later use. Using these internal sensors 318 disposed within the bore 320 of the riser assembly 310, the monitoring system 312 may monitor each function or step of downhole tools 390 that are lowered and/or lifted through the riser assembly 310.

The monitoring system 312 utilizes the communication system 322 to transmit data from tools and sensors (314 and/or 318), and any other information from the internal/external monitoring components up and down the riser assembly 310. All information from the internal and/or external sensors 314, 318 may be read into the same system (MLMS 324).

The communication system 322 may utilize any desirable transmission technique, or combination of transmission techniques. For example, the communication system 322 may include a wireless transmitter (wireless transmission), an electrical cable (wired transmission) held against a surface or built into the riser string, a fiber optic cable (optical transmission) held against a surface or built into the riser string, an acoustic transducer (acoustic transmission), and/or a near-field communication device (inductive transmission). The communication system 322 may be incorporated into a component of the riser assembly 310 and communicatively coupled (e.g., via wires) to the external and/or internal sensors associated with the riser assembly component.

Figure 20:
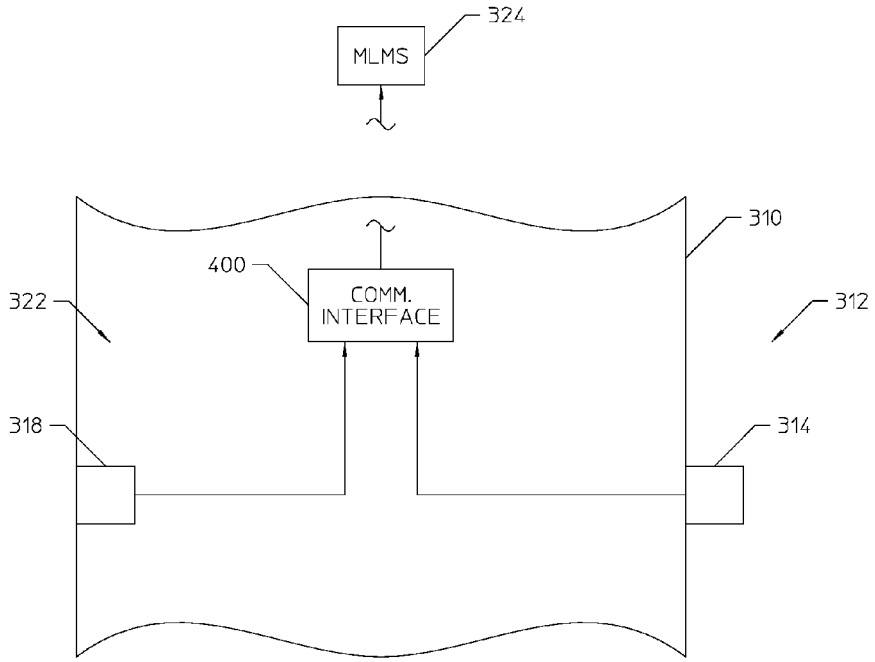
FIG. 20 shows a schematic view of a communication system that may be utilized in for external and internal monitoring of a riser assembly, in accordance with certain embodiments of the present disclosure.

FIG. 20 shows one embodiment of the communication system 322. As shown, the communication system 322 may be a simple communication interface 400 communicatively coupled to the external sensors 314 and the internal sensors 318. The communication interface 400 may transfer signals indicative of properties detected by the external sensors 314 and the internal sensors 318 to the operator monitoring system 324 as feedback regarding how the riser system is performing on a real-time or near real-time basis.

Figure 21:
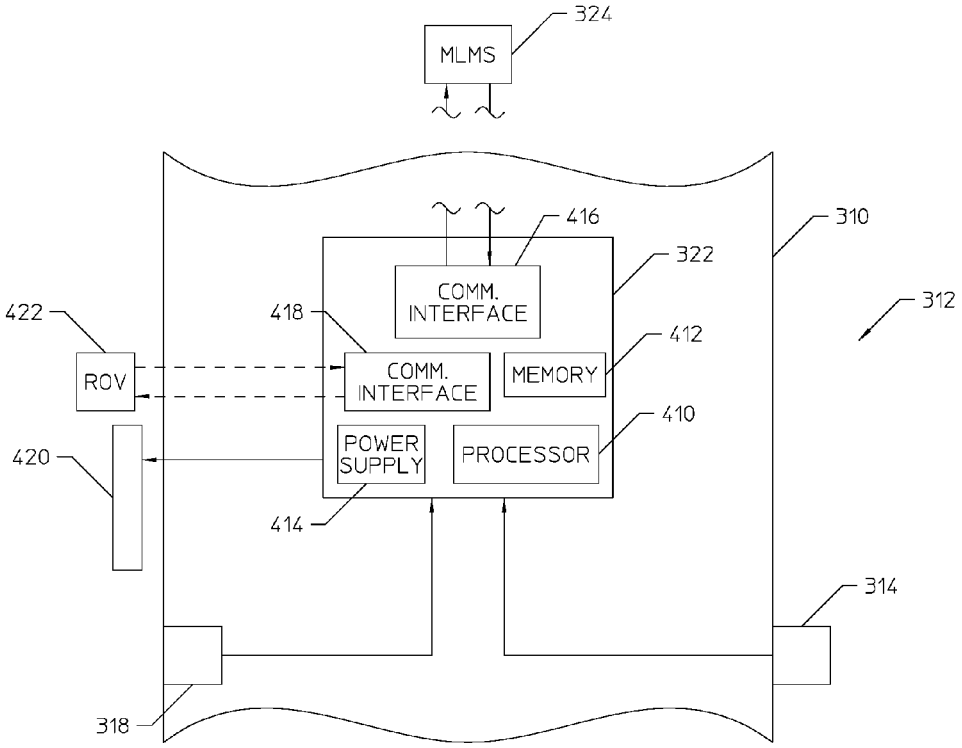
FIG. 21 shows a schematic view of a communication system that may be utilized in for external and internal monitoring of a riser assembly, in accordance with certain embodiments of the present disclosure.

Other embodiments of the communication system 322 may be more complex. As shown in FIG. 21, the communication system 322 may include one or more processor components 410, one or more memory components 412, a power supply 414, and communication interfaces 416 and 418. The one or more processor components 410 may be designed to execute encoded instructions to perform various monitoring or control operations based on signals received at the communication system 322. For example, upon receiving signals indicative of sensed properties from the external or internal sensors 314, 318, the processor 410 may provide the signals to the communication interface 416 for communicating the signals to the operator monitoring system 324. The communication interface 416 may utilize wireless, wired, optical, acoustic, or inductive transmission techniques to communicate signals from the sensors 314, 318 on the riser components to the operator monitoring system 324 at the surface.

As illustrated, the communication interface 416 may be bi-directional. That way, the communication interface 416 may communicate signals from the operator monitoring system 324 to the processor 410. Upon receiving signals from the operator monitoring system 324, the processor 410 may execute instructions to output a control signal to an actuator 420. In some embodiments, the actuator 420 may be disposed on a nearby downhole tool (e.g., tool 390 of FIG. 19) positioned within the riser assembly 311. The actuator 420 may be configured to actuate a sleeve, a seal, or any other component on the downhole tool 390 disposed within the riser assembly 311. In other embodiments, the actuator 420 may be disposed within a component of the riser assembly 311 (e.g., a termination joint) to actuate a valve.

The power supply 414 may provide backup power in the event that the operator monitoring system 324 fails or loses connection with the communication system 322. The memory component 412 may provide storage for data that is sensed by the sensors 314, 318 in the event that the operator monitoring system 324 fails or loses connection. The backup memory 412 may store the sensor data, and the communication interface 418 may enable a remotely operated vehicle (ROV) 422 or other suitable interface equipment to retrieve the stored data. In some embodiments, the ROV 422 may be configured to charge the backup power supply 414 to extend the operation of the monitoring system 312. For purposes of maintaining historical operating data for the riser assembly 310, each data record stored in the memory 412 may contain a time and date of the collection of the data.

In other embodiments, the communication system 322 of FIG. 21 may not include a direct communication interface 416 with the operator monitoring system 324 at all. That is, the communication system 322 may be equipped with the memory 412, the power supply 414, and a remote communication interface 418. In such embodiments, the processor 410 may store the detected sensor data in the memory 412 while the riser component is in use. A ROV 422 or similar instrument may occasionally be used to charge the power supply 414 to maintain the communication system 322 in operation throughout the lifetime of the well. In some embodiments, the ROV 422 or similar instrument may be used primarily to obtain the sensor data from the memory 412 and provide the data to the operator monitoring system 324 at different points throughout the life of the well. In other embodiments, upon completion of a well process the riser assembly 311 may be pulled to the surface, and the communication interface 418 may be used to transfer stored sensor data directly to the operator monitoring system 324 once the riser component has been pulled to the surface.

The external sensors 314, internal sensors 318, and communication systems 322 may be disposed on any of the components of the riser assembly 310. More detailed descriptions of the sensor arrangements and monitoring capabilities for the components of the riser assembly 310 will now be provided.

Figure 22:
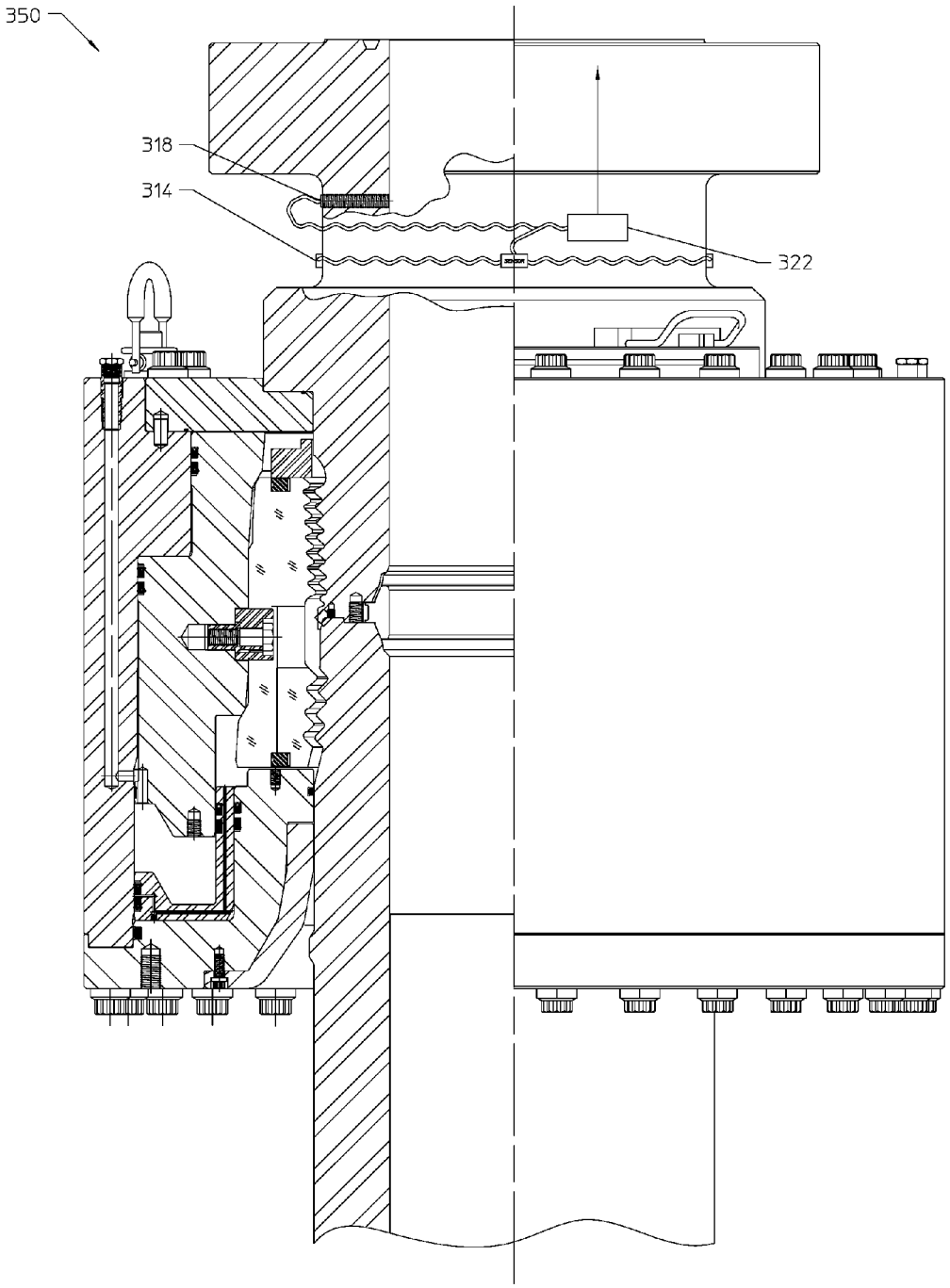
FIGS. 22-29 show schematic views of various riser assembly components equipped with an external and internal monitoring system, in accordance with certain embodiments of the present disclosure.

FIG. 22 illustrates an embodiment of the BOP connector (or wellhead connector) 350 used to connect the riser assembly 310 and the BOP 349 to the subsea wellhead 370. The BOP connector 350 may include one or more sensors 314, 318 and the communication system 322, as described above. The sensors 314, 318 may detect pressure, temperature, a locking/unlocking state of the connector, stresses (e.g., tension, compression, torsion, bending), and others properties associated with the BOP connector 350. The communication system 322 may be wired, wireless, or acoustic. As described above with reference to FIG. 21, the BOP connector 350 may further include a backup memory component (e.g., 412) to record the sensor data, so that the sensor data may be retrieved from the memory via a ROV or another communication interface.

In some embodiments, the BOP connector 350 may be able to detect and communicate signals indicative of the function of the BOP connector 350, as well as information regarding internal tools in the wellhead 370. The internal sensors 318 disposed in the BOP connector 350 may allow for the detection of internal running tools or test tools that are positioned below the BOP 349 when the rams of the BOP 349 are closed. The BOP connector 350 is in closer proximity to the wellhead 370 (and internal components being moved through the BOP 349 and the wellhead 370) than the lowest riser joint in the riser assembly 310. Therefore, it may be desirable to include the sensors 314, 318 and communication system 322 in the BOP connector 350.

The LMRP 351 may also feature external sensors 314 and/or internal sensors 318 for monitoring various riser properties, as well as the communication system 322 for communicating signals indicative of the sensed properties to the operator monitoring system 324. In some embodiments, the lower BOP stack 249 may also include such sensors 314/318 and a communication system 322.

Figure 23:
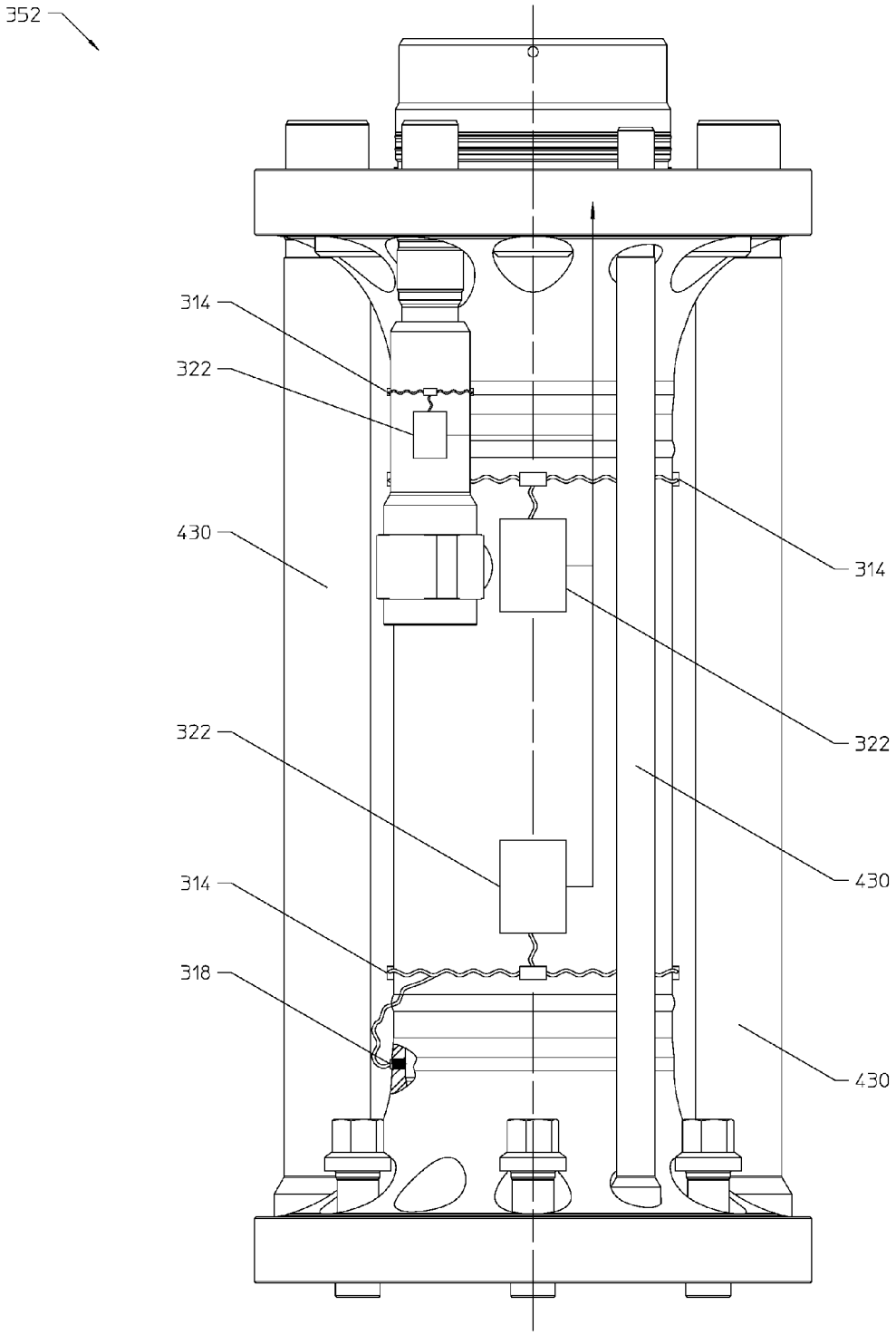

The riser extension joint 353 may include both the LMRP 351 and the boost line termination joint 352, as described above. The riser extension joint 353 generally is disposed at the top of the BOP to connect the string of riser joints to the BOP. FIG. 23 illustrates the boost line termination joint 352 of the riser assembly 310 that may be disposed at the top of the LMRP 351. The riser extension joint 353 is generally where auxiliary lines 430 terminate at a lower end of the riser assembly 310, and the terminating auxiliary lines 430 are connected to the BOP. As shown, sensors 314, 318 may be disposed on the boost line termination joint 352 to read, for example, pressures, temperatures, flow rates, stresses, and others properties associated with the boost line termination joint 352. The communication system 322, which may use wired, wireless, or acoustic transmission, may be disposed on the boost line termination joint 352 as well, to provide signals from the sensors 314, 318 to the operator monitoring system 324. In addition, the boost line termination joint 352 may include a backup memory component (e.g., 412) to record the sensor data, so that the sensor data may be retrieved from the memory via a ROV or another communication interface.

Figure 24:
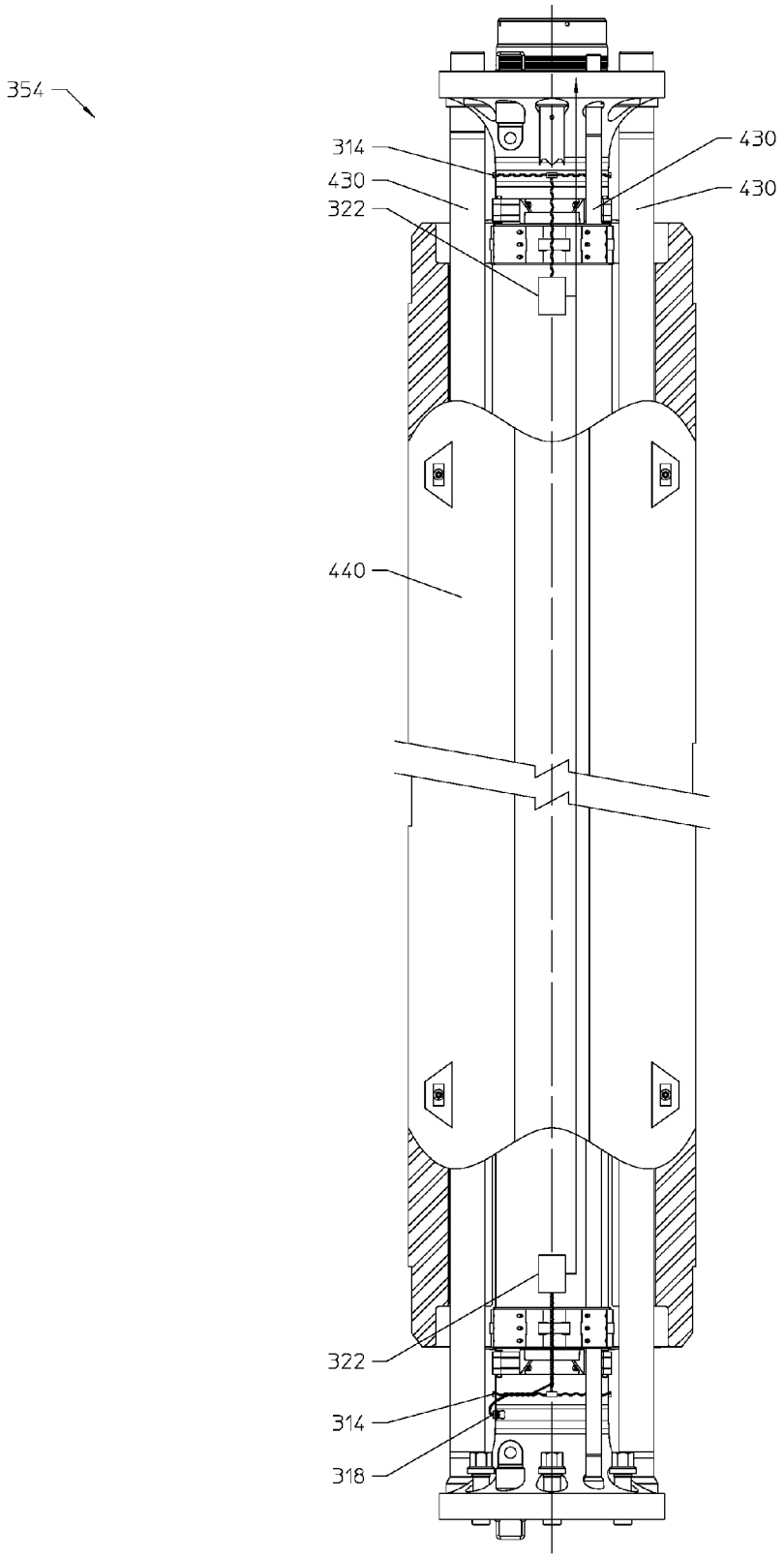

FIG. 24 illustrates a buoyant riser joint 354. The riser assembly 310 may include one or more buoyant riser joints 354 (e.g., syntactic foam buoyancy modules), which are riser joints that have a flotation device 440 attached thereto. The buoyant riser joints 354 provide weight reduction to the riser assembly 310 as desired. The buoyant riser joints 354 may be equipped with their own set of sensors 314, 318 that may read pressures, temperatures, flow rates, stresses, and others properties associated with the buoyant riser joint 354. Internal sensors 318 disposed along the bore of the buoyant riser joints 354 may be able to read flow rates and communicate with internal tools being run through the riser assembly 310.

The auto-fill valve 355 described above with reference to FIG. 18 may be utilized in certain embodiments of the riser assembly 311 to keep the riser from collapsing in the event of a sudden evacuation of the mud column therethrough. In such embodiments, the auto-fill valve 355 may include various external and/or internal sensors 314/318 for detecting various operating parameters of the auto-fill valve 355. These sensors 314/318 may interface with a communication system 322, as described above, to provide the detected operational information to the operator monitoring system 324. Other embodiments of the riser assembly 311 may not include the auto-fill valve 355.

Figure 25:
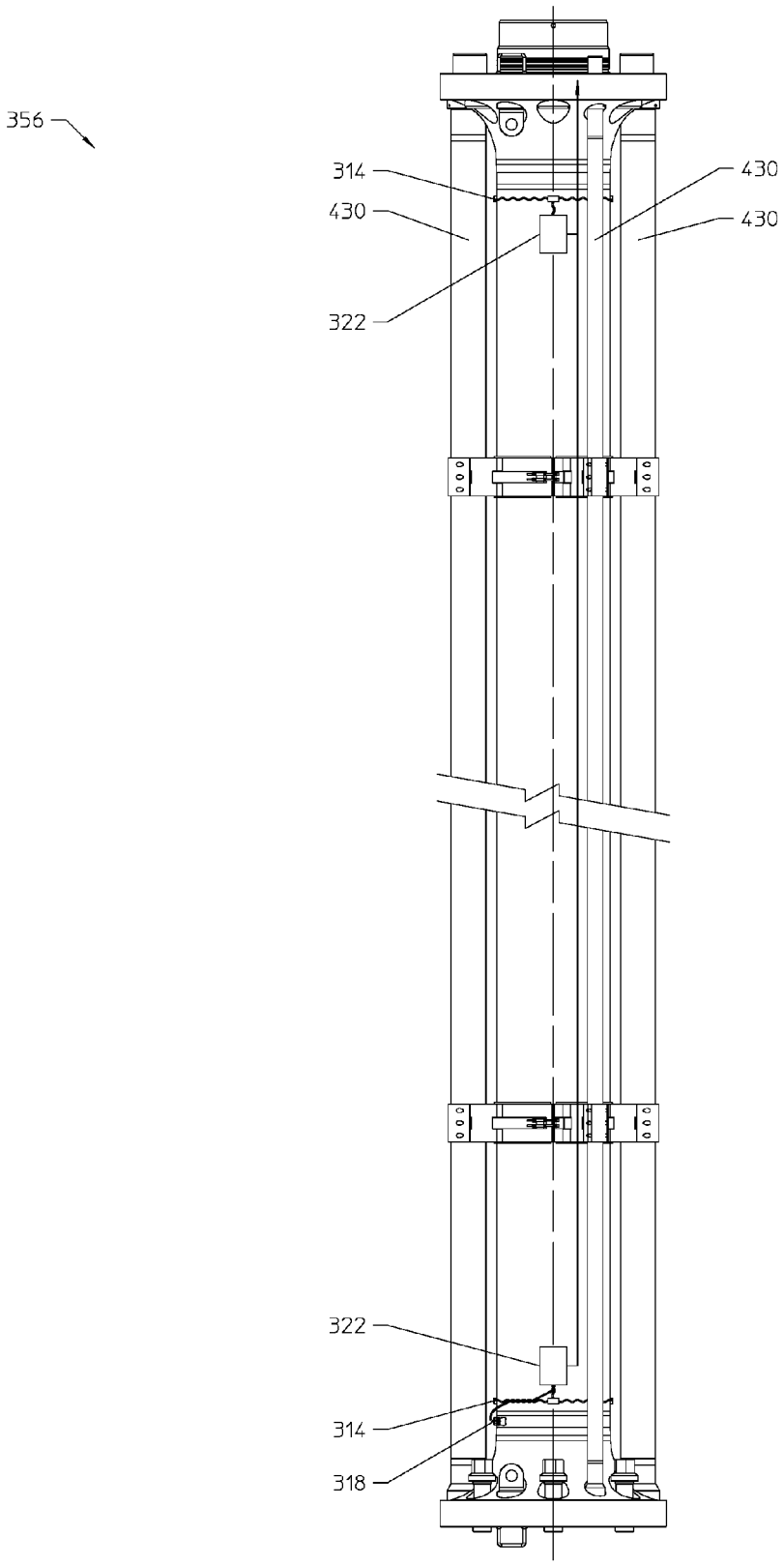

FIG. 25 illustrates a bare riser joint 356 in accordance with present embodiments. The riser assembly 310 may include one or more of these bare riser joints 356 in addition to or in lieu of the buoyant riser joints 354. Bare riser joints 356 are similar to the buoyant joints 354, but do not have flotation devices. The bare riser joints 356 may be equipped with their own set of sensors 314, 318 that may read pressures, temperatures, flow rates, stresses, and others properties associated with the bare riser joint 356. Internal sensors 318 disposed along the bore of the bare riser joints 356 may be able to read flow rates and communicate with internal tools being run through the riser assembly 310.

The riser joints (354 and 356) may be connected end to end to one another via riser joint connectors (e.g., 104 of FIG. 4), as described above. In some embodiments, the riser joint connectors 104 may be equipped with sensors 314, 318 and the associated communication system 322 to measure various properties associated with the riser joint connector 104. The sensors 314, 318 may detect, for example, pressures, temperatures, stresses, an unlocked/locked status, and other properties of the riser joint connector 104.

Figure 26:
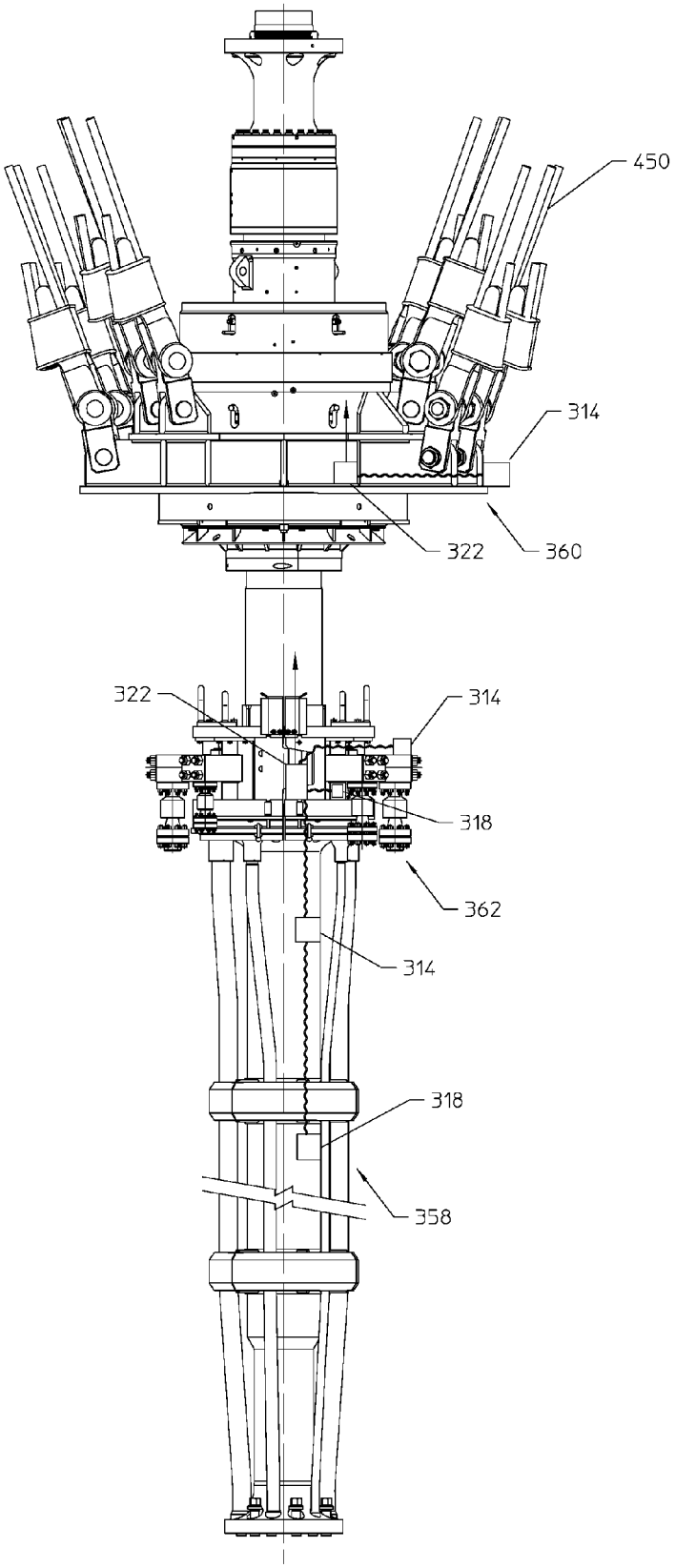

FIG. 26 illustrates the telescopic joint 358, which connects the riser string to the rig platform and to the diverter assembly 364. The telescopic joint 358 may include features that enable termination of the auxiliary lines (e.g., via termination ring 362) at the upper end (surface) of the riser assembly 310. The telescopic joint 358 may include the tension ring 360, and a rig tensioner 450 attached to the tension ring 360 provides tension to the riser string through this connection. The telescopic joint 358 is designed to telescope (i.e., expand and contract) to compensate for the movement of the rig platform, while the tension ring 360 maintains a desired tension on the riser string.

The telescopic joint 358 may include a number of sensors 314, 318 reading various aspects of the telescopic joint 358, such as length of stroke of the telescoping features, torsion, pressure, and other loads. The tension ring 360 disposed on the telescopic joint 358 may include sensors 314 (e.g., force sensors) to measure the amount of force each of the rig tensioners applies to the riser assembly 310. The termination ring 362 may also include sensors 314, 318 for measuring loads, pressures, and flow rates on the termination ring 362 itself and/or through the auxiliary lines. The sensors 314, 318 disposed throughout the telescopic joint 358, tension ring 360, and termination ring 362 may utilize one or multiple communication systems 322 to provide signals indicative of the sensed properties to the operator monitoring system 324.

Figure 27:
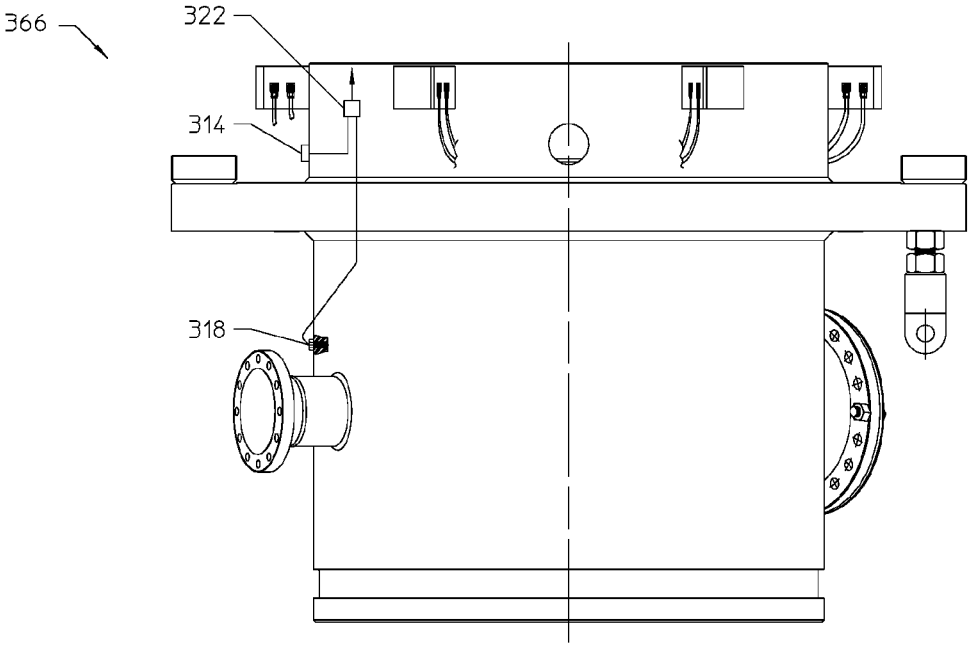
Figure 28:
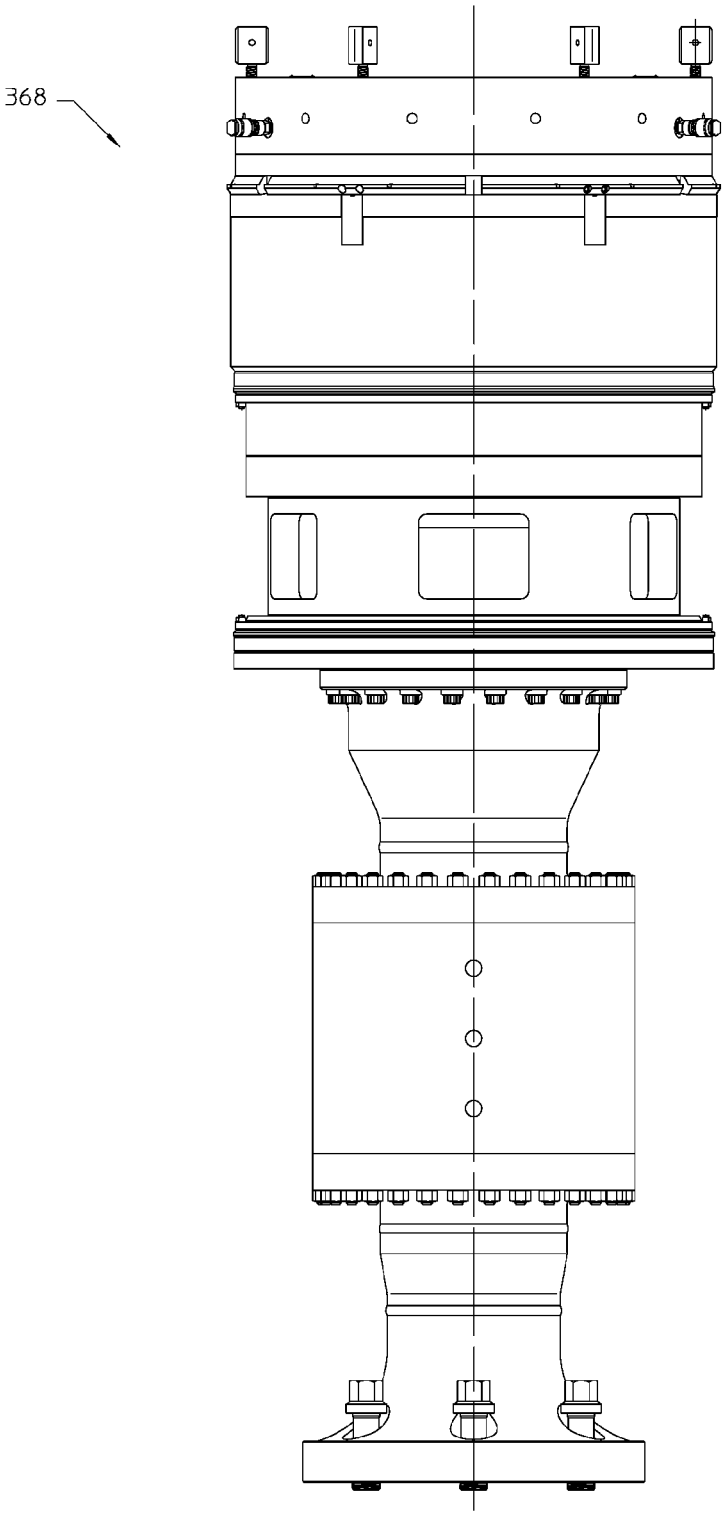

FIGS. 27 and 28 illustrate components of a diverter assembly 364 that resides below the floor of the rig platform. The diverter assembly 364 may include the diverter housing 366 (FIG. 27), as well as the diverter flex joint 368 (FIG. 28). The diverter flex joint 368 may be held at least partially within the housing 366. Most of the riser joints and other portions of the riser string run through the diverter assembly 364, and the telescopic joint 358 is connected to the diverter assembly 364 to complete the riser string. The diverter assembly 364 may be used during the drilling operations to divert fluid from an internal riser string via a flow line on the diverter assembly 364. Sensors 314/318 may be disposed within the flex joint 368 of the diverter assembly 364, as shown, to measure pressures, read valve positions, and detect various other operational properties of the diverter assembly 364. Sensors 314/318 may also be disposed within the housing 366, for example, to read an open/closed status of a packer element in the diverter assembly 364. The associated communication systems 322 may then transmit the information from the diverter assembly 364 back to the operator monitoring system 324.

Figure 29:
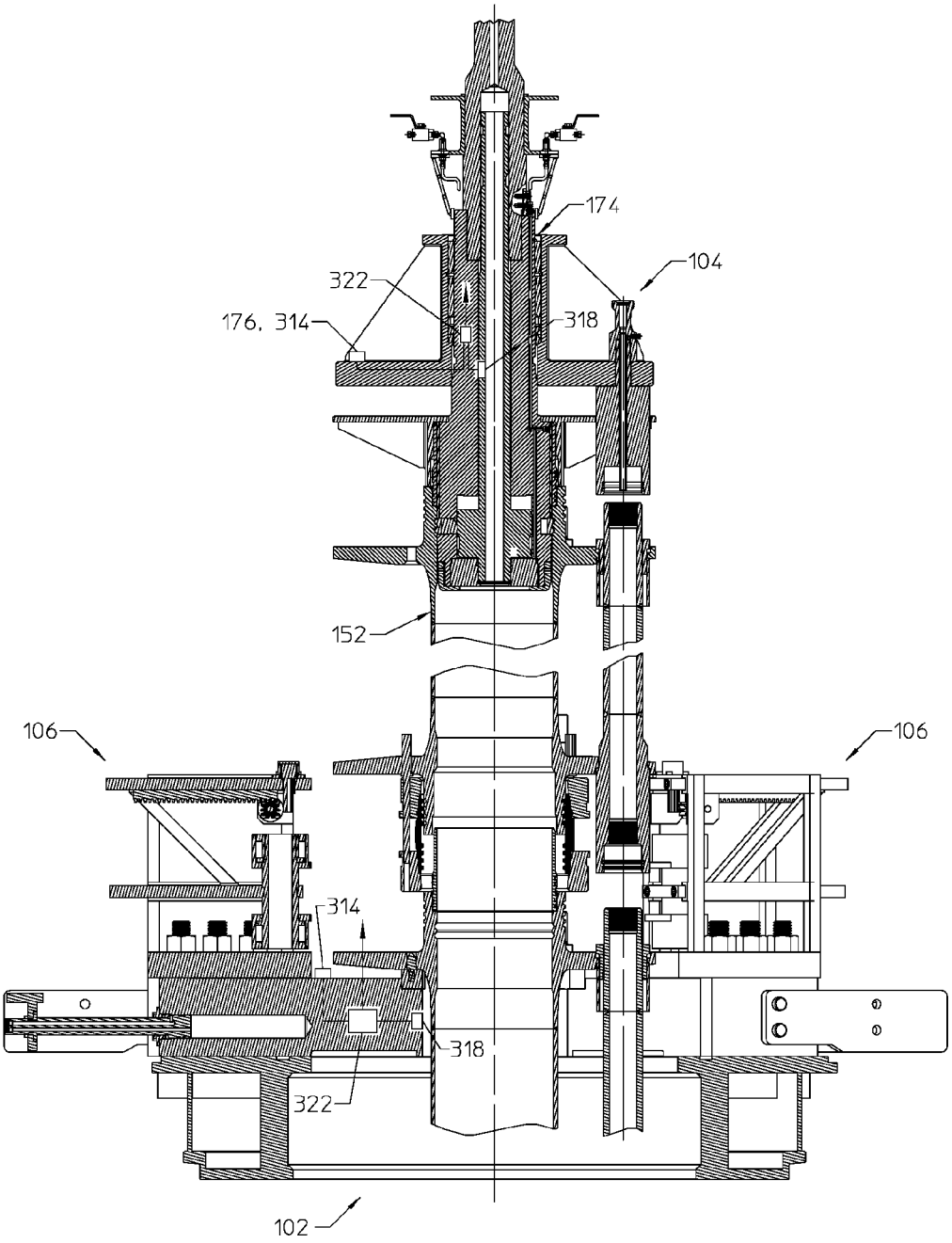

FIG. 29 illustrates the running/testing tool 174 (also referred to as a riser handling tool), which may include one or more sensors 314, 318 to measure the weight, pressure, temperature, loads, flow rates, orientation, and/or actuation of the riser handling tool 174. The riser handling tool 174 may be able to read and identify riser joints 354 (or 356) being run in to form the riser assembly 310. The riser handling tool 174 may also utilize the internal sensors 318 to ensure that the auxiliary lines (e.g., choke and kill lines) of the riser joints and fully assembled riser string are properly sealed. The riser handling tool 174 may include a communication system 322 to communicate information from the sensors 314, 318 to the operator monitoring system 324, as well as to communicatively interface with the hands free spider assembly 102.

FIG. 29 also illustrates the spider assembly 102, which allows for landing, orienting, locking, unlocking, and monitoring of the riser joints (354 and 356) as they are run into or retrieved from the riser assembly 310. The spider assembly 102 may communicate with the handling tool 174 to automate the riser running/retrieval so that the human interface is eliminated between these tools. The spider assembly 102 may include sensors 314, 318 disposed throughout to measure riser joint orientation and/or proximity, operational status of the spider assembly 102, and various other properties needed to effectively run and retrieve the riser joints. The spider assembly 102 may utilize the communication system 322 to communicate sensed properties directly to the operator monitoring system 324 and to communicate directly with the handling tool 174.

The sensors 314, 318 disposed throughout the riser assembly 310 may include, but are not limited to, a combination of the following types of sensors: pressure sensors, temperature sensors, strain gauges, load cells, flow meters, corrosion detection devices, weight measurement sensors, and fiber optic cables. The riser assembly 310 may include other types of sensors 314, 318 as well.

For example, the riser assembly 310 may include one or more RFID readers that are configured to sense and identify various equipment assets (e.g., new riser joints, downhole tools) being moved through the riser assembly 310. The equipment assets may each be equipped with an RFID tag that, when activated by the RFID readers, transmits a unique identification number for identifying the equipment asset. Upon reading the identification number associated with a certain equipment asset, the RFID readers may provide signals indicating the identity of the asset to the communication system 322, and consequently to the operator monitoring system 324.

The identification number may be stored in a database of the operator monitoring system 324, thereby allowing the equipment asset to be tracked via database operations. Additional sensor measurements relating to the equipment asset may be taken by sensors 314, 318 throughout the riser assembly 310, communicated to the operator monitoring system 324, and stored in the database with the associated asset identification number. The database may provide a historical record of the use of each equipment asset by storing the sensor measurements for each asset with the corresponding identification number.

In some embodiments, one or more of the sensors 314, 318 on the riser assembly 310 may include a fiber optic cable. The fiber optic cable may sense (and communicate) one or more measured properties of the riser assembly 310. Sensors designed to measure several different parameters (e.g., temperature, pressure, strain, vibration) may be integrated into a single fiber optic cable. The fiber optic cable may be particularly useful in riser measurement operations due to its inherent immunity to electrical noise.

The sensors 314, 318 disposed throughout the riser assembly 310 may include proximity sensors, also known as inductive sensors. Inductive sensors detect the presence or absence of a metal target, based on whether the target is within a range of the sensor. Such inductive sensors may be utilized for riser alignment and rotation during makeup of the riser string, so that the riser joints are connected end to end with their auxiliary lines in alignment.

The sensors 314, 318 disposed throughout the riser assembly 310 may include linear displacement sensors designed to detect a displacement of a component relative to the sensor. The linear displacement sensors may be disposed on the riser handling tool, for example, to detect a location of a sleeve or other riser component that actuates a sealing cap into place when connecting the riser joints together. Data collected from such linear displacement sensors may indicate how much the sleeve or other component moves linearly to set the seal (or to set a lock).

Figure 30:
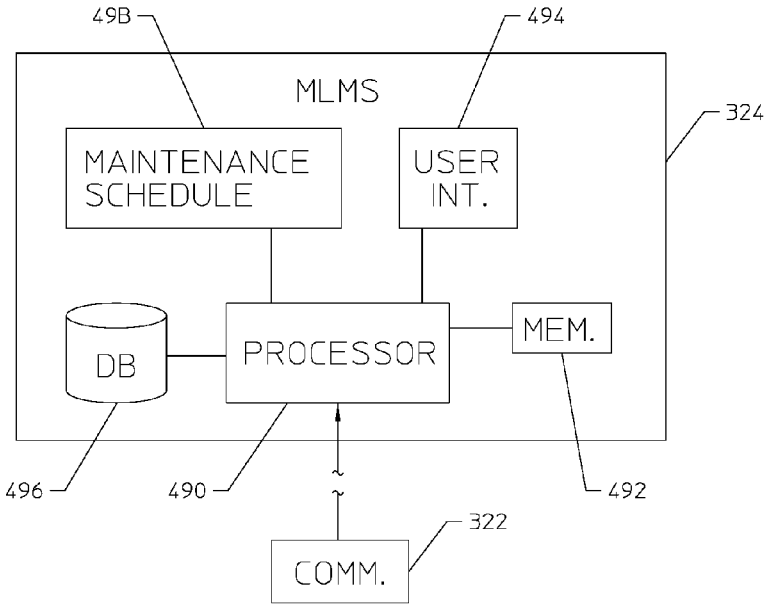
FIG. 30 shows a schematic view of an operator monitoring system, in accordance with certain embodiments of the present disclosure.

The operator monitoring system 324 may utilize various software capabilities to evaluate the received sensor signals to determine an operating status of the riser assembly 310. FIG. 30 schematically illustrates the operator monitoring system 324 (or MLMS). The operator monitoring system 324 generally includes one or more processor components 490, one or more memory components 492, a user interface 494, a database 496, and a maintenance scheduling component 498. The one or more processor components 410 may be designed to execute instructions encoded into the one or more memory components 492 to perform various monitoring or control operations based on signals received at the operator monitoring system 324. The operator monitoring system 324 may generally receive these signals from the communication system 322, or a ROV or other communication interface retrieved to the surface.

Upon receiving signals indicative of sensed properties, the processor 490 may interpret the data, display the data on the user interface 494, and/or provide a status based on the data at the user interface 494. The operator monitoring system 324 may store the measured sensor data with an associated identifier (serial number) in the database 496 to maintain historical records of the riser equipment. The operator monitoring system 324 may track a usage of various equipment assets via the historical records and develop a maintenance schedule for the riser assembly 310.

The MLMS software of the operator monitoring system 324 may manage the riser assembly 310 based on customer inputs and regulatory requirements. The system 324 may keep track of the usage of each piece (e.g., riser joint) of the riser assembly 310, and evaluate the usage data to determine how the customer might reduce costs on the maintenance and recertification of riser joints. This evaluation by the operator monitoring system 324 may enable an operator to manage the joint stresses/usage to provide the optimum use of available riser joints. In some embodiments, the operator monitoring system 324 may read (e.g., via RFID sensors) available riser joints to run while forming the riser assembly 310. The operator monitoring system 324 may build a running sequence for the riser joints to assemble a riser stack based on the remaining lifecycle of the riser assembly 310, placement within the riser string, and subsea environmental conditions.

As described above, the riser assembly 310 may include a handling tool for positioning riser components (e.g., joints) within the assembly, and the handling tool may include sensors and a communication system for communicating sensor signals to the operator monitoring system 324.

Figure 31:
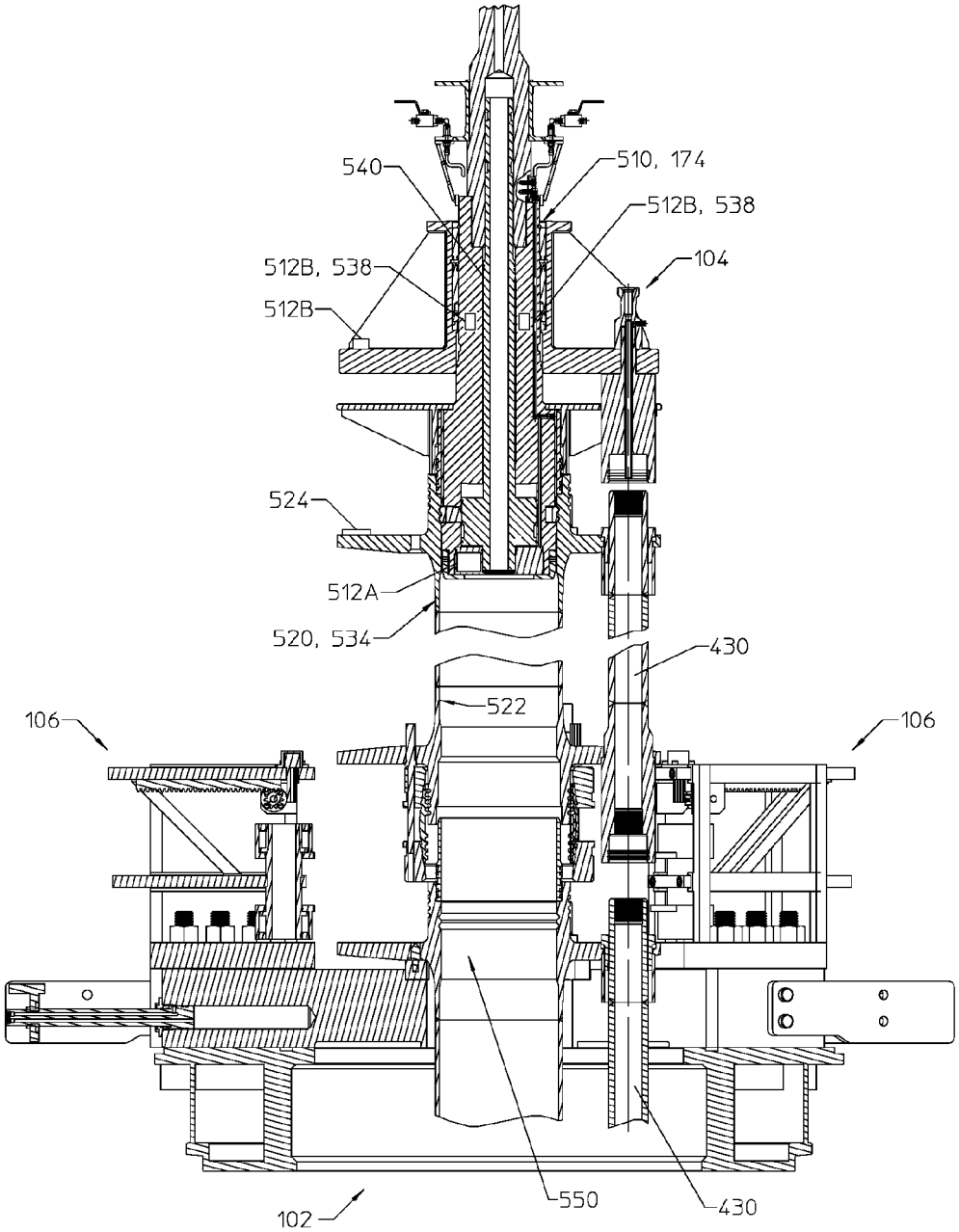
FIG. 31 shows a schematic view of a smart riser handling tool, in accordance with certain embodiments of the present disclosure.

FIG. 31 is an illustration of one such riser handling tool 510, which includes one or more sensors 512. The riser handling tool 510 also includes the communication system (322 of FIG. 29) for communicating data from the sensors 512 to the operator monitoring system 324. As described above, the communication system may include one or more processor components, one or more memory components, and a communication interface. At least one of the sensors 512A may include an electronic identification reader (e.g., RFID reader). One or more other sensors 512B may include sensors for detecting stress, strain, pressure, temperature, orientation, proximity, or any of the properties described above. The sensors 512 may be disposed internal or external to the riser handling tool 510. With the integration of these sensors 512 and computer technology, the smart riser handling tool 510 may provide increased performance and flexibility in the placement and testing of riser equipment. The smart riser handling tool 510 may provide riser joint identification, sensor measurements, and communications to the operator monitoring system 324 to provide real time or near real time feedback of riser equipment operations.

In general, the illustrated smart riser handling tool 510 is configured to engage, manipulate, and release an equipment asset 520. The equipment asset 520 may have an internal bore 522 formed therethrough. The equipment asset 520 may be a tubular component. More specifically, the equipment asset 520 may include a riser joint 534. To enable identification, the equipment asset 520 may include an electronic identification tag 524 (e.g. RFID tag) disposed on the equipment asset 520 to transmit an identification number for detection by the riser handling tool 510.

The riser handling tool 510 may be movable to manipulate the riser joint 520 into a position to be connected to a string 550 of other riser joints coupled end to end. In the illustrated embodiment, the smart handling tool 510 functions as the above described riser handling tool 174. That is, the smart riser handling tool 510 is movable to manipulate riser joints 354 to construct or deconstruct the riser string 550.

Similar "smart" handling tools may be utilized in various other contexts for manipulating equipment assets in a well environment. For example, smart handling tools may be utilized in casing running/pulling operations to manipulate casing hangers to construct or deconstruct the well. In addition, a similar smart handling tool may be used during testing of a BOP.

Smart handling tools (e.g., 510) used in these various contexts (e.g., riser construction, well construction, BOP testing, etc.) may be equipped with sensors 512 to read a landing, locking, unlocking, seal position, rotation of the smart tool, actuation of the smart tool, and/or testing of a seal or other components in the riser, casing hanger, well, or BOP. The smart handling tool may communicate (to the MLMS 324) data indicative of the steps and processes for installing or testing the riser, casing hanger, BOP, or other equipment. In some embodiments, data sensed by the smart handling tool may be stored in a memory (e.g., 412) of the smart tool and read at the surface when the smart tool is retrieved. The smart handling tool may include sensors 512 for determining pressures, temperatures, flowrates, stress (e.g., tension, compression, torsion, or bending), strain, weight, orientation, proximity, linear displacement, corrosion, and other parameters. The smart handling tool may be used to read and monitor each step of the installation, testing, and retrieval of the smart tool and its associated equipment asset (e.g., riser component, casing hanger, BOP, etc.).

The smart tool may include its own communication system 322 to communicate real-time or near real-time data to the MLMS 324. In some embodiments, the smart handling tool's communication system 322 may transmit data through the internal sensors 318 and associated communication systems 322 of the riser assembly 311 (described above) to transfer the data to the MLMS 324. For example, smart handling tools disposed below the BOP stack may transmit sensor data to the BOP connector's internal sensors and communication system (318 and 322 of FIG. 22), which then communicates the signals to the MLMS 324. This communication may be accomplished via a wired, wireless, induction, acoustic, or any other type of communication system.

Figure 32:
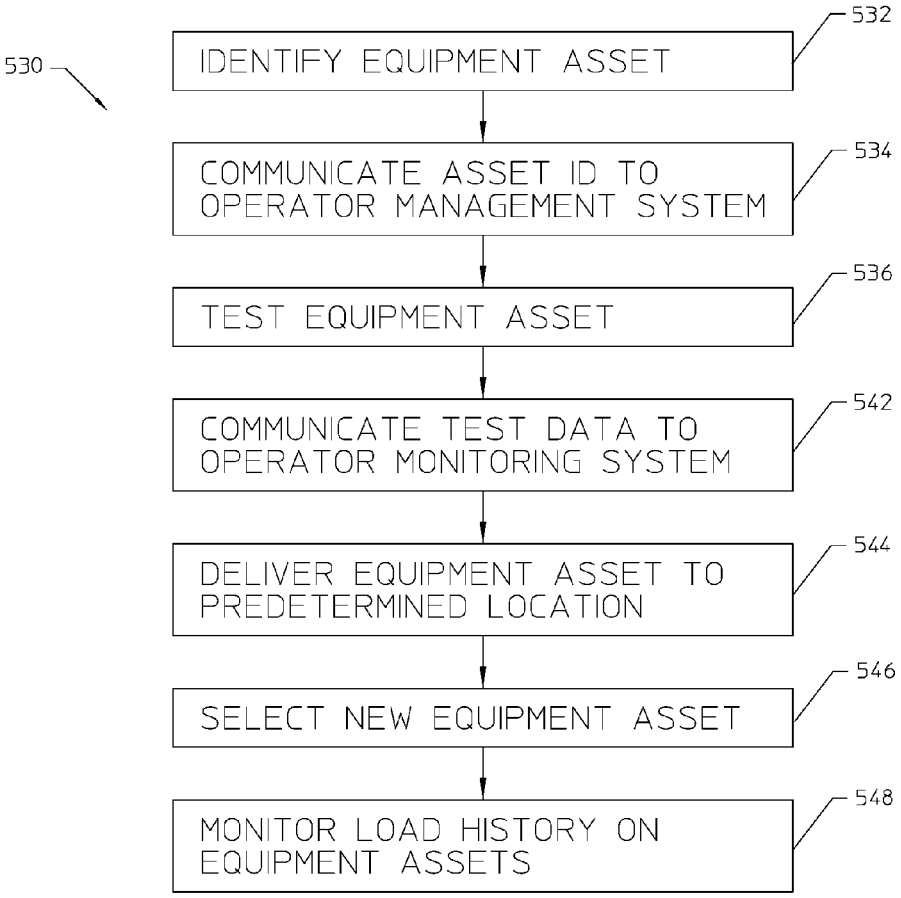
FIG. 32 shows a process flow diagram of a method for operating a smart riser handling tool, in accordance with certain embodiments of the present disclosure.

The illustrated smart riser handling tool 510 may perform various identification, selection, testing, and running functions while handling the equipment assets 520 (e.g., riser joints). FIG. 32 illustrates a method 530 for operating the smart handling tool 510. The method 530 includes identifying 532 an equipment asset 520 for manipulation at a well site. This identification may be accomplished through the use of RFID technology. That is, the smart handling tool 510 may include the electronic sensor 512A designed to read an identification number transmitted from the electronic identification tag 524 on the equipment asset 520. The method 530 generally includes communicating 534 the identification read by the electronic sensor 512A on the smart handling tool 510 to the operator monitoring system (or MLMS) 324. In some embodiments, the detected identification may be incorporated into a data block of information regarding the particular equipment asset 520 and sent to the MLMS 324.

The method 530 may further include testing 536 the equipment asset (e.g., riser joint) 520 while the asset 520 is being handled by the smart riser handling tool 510. The smart riser handling tool 510 may include a number of testing features in the form of additional sensor 512B. The sensors 512B may be configured to detect a pressure, temperature, weight, flow rate, or any other desirable property associated with the equipment asset 520.

In some embodiments, the testing involves measuring the weight of the equipment asset (e.g., riser joint) 520 while the asset 520 is suspended in the air during a running or pulling operation. As shown in FIG. 31, the smart handling tool 510 may be equipped with multiple sets of strain gauges 538 integrated into a stem 540 of the handling tool 510 to detect the weight on the equipment asset 520. The measured strain correlates to the actual weight of the equipment asset 520, and the handling tool 510 may provide a real time weight measurement for each equipment asset 520 being manipulated to assemble the subsea equipment package. These individual weight measurements of the equipment assets 520 may be collected into a database in the MLMS 324 to provide long term tracking of the weight on each equipment asset 520.

The method 530 of FIG. 32 also includes communicating 542 the test data retrieved via the sensors 512 to the MLMS 324. The test data is communicated to the MLMS 324 for storage in a database along with the identification data for the associated equipment asset 518. Each data record communicated to the MLMS 324 may contain the sensed parameter data as well as the date/time that the data was sensed and the asset identification number.

The method 530 further includes delivering 544 the equipment asset (e.g., riser joint) 520 to a predetermined location via the handling tool 510. The smart handling tool 510 may pick up and deliver the equipment asset 520 to the rig floor for incorporation and/or makeup into a subsea equipment package to be placed on the ocean bottom or a well. In other embodiments, the smart handling tool 510 may pick up an equipment asset 520 that has been separated from a subsea equipment package and return the equipment asset 520 to a surface location. Pertinent data relating to the delivery 544 of the equipment asset 520 may be collected via the sensors 512, stored, and then communicated to the MLMS 324 for inclusion in the database.

The method 530 may include selecting 546 a new equipment asset (e.g., riser joint) 520 for connection to the subsea equipment package (e.g., riser string) based on the identification of the equipment asset 518. The smart handling tool 510 may verify that the equipment assets being connected together are in a proper sequence within the equipment package, based on data from the MLMS 324. Since each equipment asset 520 has its own unique identifier in the form of an electronic identification tag or similar feature, the MLMS 324 may organize the pertinent sensor data for each individual equipment asset 520 in the database. This information may be accessed from the database in order to select 546 the next equipment asset 520 to be placed in the sequence of the subsea equipment package.

The MLMS 324 may monitor 548 a load history on the equipment assets 520 based on information that is sensed and stored within the database for each identified equipment asset 520. This information may be accessed and evaluated for the purpose of recertification of the equipment assets 520 being used throughout the system. This load history may be monitored 548 for each equipment asset 520 (e.g., joint) that has been connected in series to form the subsea equipment package (e.g., riser). The accurate log of historical load data stored in the database of the MLMS 324 may allow the operator to recertify the equipment assets 520 only when necessary based on the measured load data. The historical load data may also help with early identification of any potential equipment failure points.

In the context of the riser assembly 310 described at length above, the smart handling tool 510 of FIG. 31 may provide live data to the MLMS 324 during the installation and retrieval of the riser assembly 310. The smart handling tool 510 may provide identification of the riser joints 354 (or 356) through RFID technology. In some embodiments, the smart handling tool 510 may also provide test data relating to the operation of the auxiliary lines 430 through the riser joints 354. As described above, the smart handling tool 510 may provide weight data relating to both the riser string and the individual riser joints 354.

In some embodiments, the smart handling tool 510 may provide orientation data for landing and retrieving the riser joints 354. As mentioned above, the smart handling tool 510 may communicate with the spider assembly 102. Based on sensor feedback from the spider assembly 102, the handling tool 510 may orient the riser joint appropriately for auxiliary line connection to the previously set riser joint, and land the riser joint onto the flange of the previously set riser joint. The smart spider assembly 102 may perform the locking procedure if running the riser joint, or the unlocking procedure if pulling the riser joints.

FIG. 31 illustrates the smart handling tool 510 being used to run riser joints 354 to construct the riser string 550. It should be noted that a similar procedure may be followed to run other types of tubular components or equipment assets, including casing joints, BOP units, drill pipe, and others. First, the smart handling tool 510 may be connected to the riser joint 354 in a storage area at the well site and may read the electronic identification tag 524 to identify the joint 354. The smart handling tool 510 then communicates the riser joint ID to the database in the MLMS 324. The smart handling tool 510 may move the riser joint 354 to the rig floor for connection to the riser string 550. While moving the riser joint 354, the handling tool 510 may measure the weight of the joint via the strain gauges 538 and communicate the detected weight data to the MLMS database.

The smart handling tool 510 may then lower the riser joint 354 onto the landing ring of the spider assembly 102, and orient the riser joint 354 to match the receiving joint already in the spider assembly 102. The spider assembly 102 may connect the two joints 354 together, as described above. After connecting the joints, the spider assembly 102 may actuate the dogs 116 out of the way so that the spider assembly 102 is no longer supporting the riser connection 104. Instead, the smart handling tool 510 is fully supporting the riser string 550.

The smart handling tool 510 may then test the auxiliary lines 430 of the riser string 550, ensuring that the auxiliary lines 430 are properly sealing between adjacent riser joints 354. The smart handling tool 510 may communicate the measurement feedback of the auxiliary line test to the database records in the MLMS 324. The smart handling tool 510 may raise the riser string 550, measure the weight of the entire riser string 550 via the strain gauges 538, and communicate the measured weight to the MLMS 324. The smart handling tool 510 then lowers the riser string 550 to land the top flange onto the landing ring of the spider assembly 102. The steps of this running method may be repeated until the entire riser string 550 has been run and landed on the subsea wellhead.

The procedure for pulling the riser string 550 using the smart handling tool 510 is similar to the procedure for running the riser string 550, but in reverse. Again, this procedure may be applied to any desirable type of equipment assets (e.g., riser, casing, BOP, drill pipe, or other) that are being pulled via a smart handling tool 510. During the pulling procedure, the smart handling tool 510 starts by picking up the riser string 550. The spider assembly 102 may open to allow the smart handling tool 510 to raise the riser string 550, and the smart handling tool 510 may weigh the riser string 550 via the strain gauges 538 and communicate the data to the database of the MLMS 324.

The spider assembly 102 may close around the top flange of the second riser joint from the top of the riser string 550, and the smart handling tool 510 may land the riser string 550 onto the landing ring of the spider assembly 102. The spider assembly 102 then unlocks the upper riser joint 354 from the rest of the riser string 550. The spider assembly 102 may record the amount of force required to unlock the joint 354 via one or more sensors disposed on the spider assembly 102, and communicate the force measurement to the MLMS 324. The smart handling tool 510 raises the disconnected riser joint 354 away from the rest of the riser string 550, pauses to weigh the individual riser joint 354, then delivers the riser joint 354 to the storage area. The identification and weight measurement for the riser joint 354 is communicated to the database in the MLMS 324 for record keeping. The pulling process may be repeated until all the riser joints 354 of the riser string 550 have been disconnected and retrieved to the surface.

In the riser assembly examples given above, the smart handling tool 510 may utilize the sensors 512 to detect certain properties of the riser assembly 310 throughout the running and pulling operations. For example, the data detected from the sensors 512 may include the identification of each riser joint 354 read via an electronic identification reader on the smart handling tool 510. The data may also include strain gauge data indicative of the weight of the individual riser joint 354 being held by the smart handling tool 510. In addition, the data may include strain gauge data indicative of the weight of the riser string 550 as the riser string 550 is being assembled or disassembled.

Further, the data may include data indicative of auxiliary line testing performed by the smart handling tool 510 to ensure a leak free assembly of the auxiliary lines 430 connected through the riser assembly 310. For example, pressure sensors on the smart handling tool 510 may measure a test pressure of the auxiliary lines of the riser string and communicate the test results to the MLMS 324. The pressure test may be performed on an individual riser joint 354 before connecting the riser joint 354 to the riser string, or before moving the riser joint 354 to the rig for running the joint. A second pressure test may also be performed after the riser joint 354 has been connected to the riser string 550 to provide the pressure test results for the entire riser string 550. The riser string test may be performed multiple times throughout the running of the riser string 550, and a final test of the auxiliary lines 430 may be conducted to verify that the entire riser assembly 310 has been tested and the riser string is available for subsea drilling operations.

Accordingly, certain embodiments of the present disclosure allow for hands-free riser section coupling systems and methods. Certain embodiments allow for minimal and remote operator involvement. As a result, certain embodiments provide safety improvements in part by eliminating or significantly reducing direct operator involvement that would otherwise expose an operator to risks of injury, fatigue, and increased potential for human error. Moreover, certain embodiments allow for increased speed and efficiency in the riser section coupling process. Certain embodiments allow for lighter coupling components, for example, by eliminating or significantly reducing the need for heavy bolts and flanges. This may save material usage and augment the speed and efficiency of the riser section coupling process.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A system, comprising:

a riser running tool comprising a tool connector interface configured to be received inside and selectively engaged with an equipment asset, wherein the riser running tool is movable to engage, lift, and lower the equipment asset relative to a spider assembly mounted on a vessel or platform, wherein the riser running tool comprises:

one or more sensors disposed on the riser running tool for measuring one or more properties associated with the equipment asset; and a communication system disposed on the riser running tool and coupled to the one or more sensors to communicate data indicative of the one or more measured properties to an operator monitoring system located on the vessel or platform.

2. The system of claim 1, wherein the riser running tool further comprises an electronic identification reader for identifying the equipment asset, wherein the communication system is coupled to the electronic identification reader to communicate data indicative of an equipment asset identification to the operator monitoring system.

3. The system of claim 2, wherein the electronic identification reader comprises a radio frequency identification (RFID) reader.

4. The system of claim 1, wherein the riser running tool is movable to manipulate riser joints to construct or deconstruct a riser string.

5. The system of claim 1, further comprising the spider assembly, wherein the spider assembly comprises a connector actuation tool to connect a riser joint engaged by the riser running tool with a string of riser joints held by the spider assembly.

6. The system of claim 5, wherein the communication system of the riser running tool is communicatively coupled to the spider assembly.

7. The system of claim 1, wherein the one or more sensors comprise a temperature sensor, a pressure sensor, a load cell, a strain gauge, a flow meter, a proximity sensor, an optical fiber, or a combination thereof.

8. A method, comprising:

engaging a riser joint via a riser running tool using a tool connector interface of the riser running tool received into a bore of the riser joint;

sensing one or more properties associated with the riser joint via one or more sensors disposed on the riser running tool;

communicating the one or more sensed properties via a communication system disposed on the riser running tool to an operator monitoring system located on a vessel or platform for incorporation into a database; and lifting or lowering the riser joint to a predetermined location relative to a spider assembly mounted on the vessel or platform via the riser running tool.

9. The method of claim 8, further comprising:

determining an identification of the riser joint via an electronic identification reader disposed on the riser running tool; and communicating the identification of the riser joint to the operator monitoring system for incorporation into the database.

10. The method of claim 9, wherein determining the identification of the riser joint comprises reading a radio frequency identification (RFID) tag disposed on the riser joint via the electronic identification reader.

11. The method of claim 8, further comprising:

connecting the riser joint to an upper joint of a riser string to extend the riser string via the spider assembly, sensing one or more properties associated with the entire aggregate riser string via the one or more sensors disposed on the riser running tool; and communicating the one or more sensed properties of the riser string to the operator monitoring system.

12. The method of claim 11, further comprising:

connecting a plurality of riser joints together to form the riser string via the riser running tool and the spider assembly;

sensing one or more properties of each of the plurality of riser joints individually via the one or more sensors disposed on the riser running tool before connecting the riser joint to the riser string; and sensing one or more properties associated with the entire aggregate riser string via the one or more sensors after connecting each individual riser joint thereto.

13. The method of claim 11, further comprising:

orienting the riser joint with respect to the spider assembly via the riser running tool; and connecting the riser joint to the upper joint of the riser string via the spider assembly.

14. The method of claim 8, further comprising:

supporting a riser string from the riser running tool, wherein the riser string comprises the riser joint;

sensing one or more properties associated with the entire aggregate riser string via the one or more sensors disposed on the riser running tool;

communicating the one or more sensed properties of the entire riser string to the operator monitoring system; and decoupling the riser joint from the riser string.

15. The method of claim 8, wherein sensing one or more properties via the one or more sensors disposed on the riser running tool comprises testing an auxiliary line of the riser joint via the one or more sensors.

16. The method of claim 15, wherein testing the auxiliary line comprises testing a seal between the auxiliary line of the riser joint and an auxiliary line of an adjacent riser joint.

17. The method of claim 8, wherein sensing one or more properties via the one or more sensors disposed on the riser running tool comprises sensing a weight of the riser joint via the one or more sensors.

18. The method of claim 8, further comprising storing the one or more sensed properties in the database with a time stamp for the sensor measurement.

19. The method of claim 18, further comprising monitoring a load history of a plurality of riser joints via sensor measurements stored in the database.

20. The method of claim 8, further comprising selecting a new riser joint for placement in a sequence of riser joints coupled together based on a detected identification of the new riser joint and a load history for the new riser joint stored in the database.

* * * * *